US006956478B2

(12) United States Patent
Oyagi et al.

(10) Patent No.: US 6,956,478 B2
(45) Date of Patent: Oct. 18, 2005

(54) SECURITY TERMINAL, SECURITY MANAGEMENT METHOD, MONITOR DEVICE, MONITOR METHOD, AND SECURITY SYSTEM

(75) Inventors: Masayuki Oyagi, Kyoto (JP); Masaki Yamato, Kyoto (JP); Shoichi Tanaka, Kyoto (JP); Toru Akatsu, Kyoto (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 10/087,997

(22) Filed: Mar. 5, 2002

(65) Prior Publication Data

US 2002/0126009 A1 Sep. 12, 2002

(30) Foreign Application Priority Data

Mar. 7, 2001 (JP) ..... 2001-063390

(51) Int. Cl.[7] ..... G08B 13/00

(52) U.S. Cl. ..... 340/541; 340/429; 340/426.3; 340/988; 340/989; 340/902; 340/905

(58) Field of Search ..... 340/541, 429, 340/426.3, 988, 989, 902, 905, 531, 539.1, 506, 514, 601, 628, 426.1

(56) References Cited

U.S. PATENT DOCUMENTS

| | | | | | |
|---|---|---|---|---|---|
| 4,257,038 | A | * | 3/1981 | Rounds et al. | 340/539.16 |
| 4,531,114 | A | | 7/1985 | Topol | |
| 4,772,876 | A | * | 9/1988 | Laud | 340/539.22 |
| 5,892,442 | A | * | 4/1999 | Ozery | 340/539.14 |
| 6,028,506 | A | * | 2/2000 | Xiao | 340/426.21 |
| 6,067,007 | A | * | 5/2000 | Gioia | 340/426.19 |
| 6,255,953 | B1 | * | 7/2001 | Barber | 340/601 |
| 6,400,265 | B1 | * | 6/2002 | Saylor et al. | 340/531 |
| 6,791,456 | B2 | * | 9/2004 | Nakayama et al. | 340/429 |

FOREIGN PATENT DOCUMENTS

| | | |
|---|---|---|
| EP | 0039203 | 4/1985 |
| FR | 2661023 | 4/1990 |
| FR | 2666020 | 9/1990 |
| GB | 2343975 | 5/2000 |
| JP | 02-002224 | 1/1990 |
| JP | 03-070650 | 3/1991 |
| JP | 04-081998 | 3/1992 |
| JP | 04-231238 | 8/1992 |
| JP | 04-373100 | 12/1992 |
| JP | 08-273075 | 10/1996 |
| JP | 09-261374 | 10/1997 |
| JP | 10-069589 | 10/1998 |
| JP | 11-161884 | 6/1999 |
| JP | 11-203579 | 7/1999 |
| JP | 11-283160 | 10/1999 |
| JP | 2000-011285 | 1/2000 |
| WO | 0017021 | 3/2000 |

* cited by examiner

*Primary Examiner*—Tai T. Nguyen
(74) *Attorney, Agent, or Firm*—Foley & Lardner LLP

(57) ABSTRACT

In a case where an intruder is detected in a house, a detection signal is outputted from a home security communication device, and is notified to a monitor center through an in-area communication management device by a wireless connection. The monitor center notifies a portable telephone owned by a resident of the house that the intruder exists in the house and also notifies houses to in the area that the intruder exists in the house.

4 Claims, 35 Drawing Sheets

Portable Telephone 71

Center Device 82

Portable Telephone 71

Home Security Device 81

Portable Telephone 71

Portable Telephone 71

Center Device 82

Home Security Device 81

Portable Telephone 71

SECURITY TERMINAL, SECURITY MANAGEMENT METHOD, MONITOR DEVICE, MONITOR METHOD, AND SECURITY SYSTEM

CROSS-REFERENCE TO RELATED PATENT APPLICATIONS

Priority Japanese Patent Application No. 63390/2001, filed Mar. 7, 2001 including the specification, drawings, claims and abstract, is incorporated by reference herein in its entirety.

BACKGROUND OF THE INVENTION

1. Field of the Invention

The present invention relates to a security terminal, a security management method, a monitor device, a monitor method, and a security system, and more particularly, to a security terminal, a security management method, a monitor device, a monitor method, and a security system, in which the spread of damage can be suppressed.

2. Description of the Related Art

In recent years, various security systems have been proposed to prevent an emergent situation from occurring, such as a robbery or a fire, or to suppress its damage to a minimum.

FIG. 1 is a block diagram showing one such conventional security system. A house 1 is provided with a security device 11 for detecting the occurrence of an emergency situation, and a communication device 12 connected to a public telephone circuit 2.

When the security device 11 detects the emergency situation, the communication device 12 notifies a control center 3 accordingly through the public telephone circuit 2. When receiving the notification, the control center 3 gives it to a depot 4, such as a security company, and the depot 4 makes inquiries or the like to the resident of the house 1.

For example, when the security device 11 detects a fire, the depot 4 makes inquiries (e.g., telephones the resident of the house 1), and the resident of the house 1 reports the degree of the fire or the like and is informed of suitable measures to be taken.

However, in a conventional security system, when an unusual situation occurs in the house 1, inquiries are generally made to only the resident of the house 1, and instructions (e.g., suitable measures to be taken) are only given to the resident of the house.

Accordingly, in the case where the fire occurs in the house 1, although instructions (e.g., suitable measures to be taken) are given to the resident of the house 1, such instructions are not given to residents in the vicinity of the house 1. On the contrary, it can also be expected that in some instances residents in the vicinity of the house may not even notice the occurrence of the fire.

As a result, damage suppression (e.g., the safety of residents in the vicinity of the house 1) remains a problem.

SUMMARY OF THE INVENTION

The present invention is directed at reducing one of more of the problems set forth above, and other problems found within the prior art.

According to one aspect of the present invention, a security terminal of the present invention is provided comprising detection means for detecting an occurrence of an unusual situation, and notification means for notifying a monitor device of the occurrence of the unusual situation, when the occurrence of the unusual situation is detected by the detection means, through a management device for managing communication in an area to which the security terminal itself belongs.

The security terminal preferably includes, for example, each of home security devices 81-1 to 81-N (FIG. 5) or an on-vehicle device 151 (FIG. 26), and is installed in a house, a vehicle or the like. In the case where the security terminal is installed in the house, the unusual situation may include, for example, sneak-thieving (e.g., robbery/burglary/larceny), fire, gas leakage or the like. In the case where the security terminal is installed in the vehicle, the unusual situation may include, for example, stealing of the vehicle or malicious mischief to the vehicle (e.g., puncturing a tire, scratching the vehicle body, or the like). The unusual situation can also include a case where communication can not be made with the security terminal.

In the case where the security terminal is installed in the house, the detection means may comprise one or more of, for example, a gas sensor 52, an emergency button 53, a magnet switch 54, and a fire sensor 55 (FIG. 3). The detection means may also comprise a breakage sensor for detecting the breakage of a window, a vibration sensor, or the like.

In the case where the security terminal is installed in the vehicle, the detection means may compose one or more of, for example, an acceleration sensor 174, a door sensor 175, and a trunk sensor 176 (FIG. 27). The detection means may also comprise a sensor for detecting the rotation of a handle, a sensor for detecting the pressure of a seat, a sensor for detecting the starting of an engine, a sensor for detecting the inclination of a vehicle body, or the like.

The notification means may comprise, for example, a home security communication device 42 (FIG. 3), which preferably communicates with a management device for managing communication in an area by a wireless connection. This management device preferably comprises, for example, an in-area communication management device 32-1 (FIG. 5).

Preferably, the area is previously determined, for example, at a range of hundreds of meters in radius, a range of hundreds of houses, or the like. The management device receives an electric wave transmitted from a home security terminal in the area, and transmits it to the monitor device. The management device also receives an electric wave transmitted from the monitor device, and transmits it to the respective home security terminals. This monitor device may comprise, for example, a center device 82 (FIG. 5).

The security terminal further comprises threatening means for threatening against the occurrence of the unusual situation, and the threatening means can be made to operate on the basis of control from the monitor device.

In the case where the security terminal is installed in a house, the threatening means may comprise, for example, an outside light 56 and/or an outside speaker 57 (FIG. 3). When the occurrence of the unusual situation is detected in the area, the threatening means is driven by control of the monitor device to brighten the surroundings and to sound the alarm. In the case where the security terminal is installed in a vehicle, the threatening means may comprise a horn 177 and a lamp 178 (FIG. 27).

The notification means can notify the management device of the occurrence of the unusual situation by a wireless connection.

A security terminal installed in a vehicle may further comprise an acquisition means for acquiring position information, and the notification means can further notify the position information acquired by the acquisition means.

The acquisition means may comprise, for example, a GPS (Global Positioning System) 173 (FIG. 27). The transmission means may comprise, for example, an on-vehicle communication device 161 (FIG. 27).

In the case where a vehicle is stolen and a chase mode is selected, the acquisition means can also acquire position information and output it to the monitor device.

According to another aspect of the present invention, a security management method of a security system is provided comprising a detection step of detecting occurrence of an unusual situation, and a notification step of notifying a monitor device of the occurrence of the unusual situation, when the occurrence of the unusual situation is detected by a processing of the detection step, through a management device for managing communication in an area to which the security system itself belongs.

The detection step may comprise, for example, step S2 of FIG. 9, and the notification step may comprise step S3 of FIG. 9.

In the security terminal and the security management method of the present invention, when the occurrence of the unusual situation is detected, the occurrence of the unusual situation is preferably notified to the monitor device through the management device for managing the communication in the area to which the security terminal itself belongs.

Since information relating to the occurrence of the unusual situation for each of plural areas is notified to the monitor device, the monitor device can acquire overall crime prevention information. The collected crime prevention information can be used to counsel caution in an area where unusual situations often occur in advance. In the monitor of vehicles, for example, car types with a high possibility of being damaged can be specified, and owner of that car type can be cautioned in advance.

A monitor device of the present invention may comprise first notification means for notifying a plurality of security terminals of an occurrence of an unusual situation denoted by a first security terminal, the plurality of second security terminals being installed in a predetermined area where the first security terminal is installed, storage means for storing a notice destination to which information is sent when the unusual situation is detected by the first security terminal, and second notification means for notifying the notice destination stored in the storage means of the occurrence of the unusual situation.

The first notification means may comprise, for example, a center control device 101 (FIG. 5) for carrying out a processing of step S15 of FIG. 10. The storage means may comprise, for example, a storage device 104 (FIG. 7). The second notification means may comprise, for example, the center control device 101 (FIG. 5) for carrying out a processing of step S14 of FIG. 10.

The first security terminal is preferably a security terminal which detects the unusual situation, and the second security terminals are preferably security terminals installed in the same general area as the first security terminal.

The first notification means notifies all the security terminals in the area that a security terminal having detected the unusual situation exists in the area. Preferably, second notification means notifies a portable telephone or the like previously set as the notice destination to which information is sent when the unusual situation is detected in a house or a vehicle.

The notice destination may include, for example, a mail address, a telephone number (e.g., of a portable telephone number, a PHS (Personal Handy Phone) terminal, a PDA (Personal Digital Assistants), a personal computer or the like. Preferably, the notice destination is predetermined.

The first notification means can include management means provided for every area, for managing communication with the security terminals in the controlled area. The management means may comprise, for example, an in-area communication management device 32-1 of (FIG. 5).

The management means preferably can communicate with the security terminals by a wireless connection.

The first notification means may notify the first security terminal and the second security terminals to drive threatening devices, in addition to a message to notify them of the occurrence of the unusual situation.

The threatening device may comprise, for example, an outside light 56, an outside speaker 57, and/or the like in the foregoing security terminal. As stated above, when the unusual situation occurs, by driving the threatening device to threaten, the spread of damage of sneak-thieving can be suppressed.

According to another aspect of the present invention, a monitor method is provided comprising a first notification step of notifying a plurality of second security terminals of an occurrence of an unusual situation detected by a first security terminal, the plurality of second security terminals being installed in a predetermined area where the first security terminal is installed, a storage step of storing a notice destination to which information is sent when the unusual situation is detected by the first security terminal, and a second notification step of notifying the notice destination stored by a processing of the storage step of the occurrence of the unusual situation.

The first notification step may comprise, for example, step S15 of FIG. 10. The storage step may comprise, for example, a processing for previously setting notice destination specifying information. The second notification step may comprise, for example, a processing of step S14 of FIG. 10.

According to another aspect if the present invention, a security terminal of a security system is provided comprising detection means for detecting occurrence of an unusual situation, and first notification means for notifying a monitor device of the occurrence of the unusual situation, when the occurrence of the unusual situation is detected by the detection means. The monitor device preferably comprises second notification means for notifying the other of a plurality of security terminals, of the occurrence of the unusual situation, when one of the plurality of security terminals detects occurrences of the unusual situation, storage means for storing a notice destination to which information is sent when the unusual situation is detected by the one of the plurality of security terminals, and third notification means for notifying the notice destination stored in the storage means of the occurrence of the unusual situation.

In the security system of the present invention, when the occurrence of the unusual situation is detected, the occurrence of the unusual situation is preferably notified to the monitor device. When detection of the unusual situation is notified from the security terminal, in addition to the security terminal, the occurrence of the unusual situation is notified to the other security terminals in the area where the security terminal is installed, and the occurrence of the unusual situation is notified to the notice destination stored as the notice destination to which information is sent when the unusual situation is detected by the security terminal.

When an unusual situation occurs, since the occurrence of the unusual situation is notified to not only the person concerned (in the case where the unusual situation occurs in a house, the resident of the house, or in the case where the unusual situation occurs in a vehicle, the owner of the vehicle), but also neighbor residents, the spread of damage can be suppressed. That is, the neighbor residents can also deal with the unusual situation.

DETAILED DESCRIPTION OF THE PREFERRED EMBODIMENTS

Figure 1:
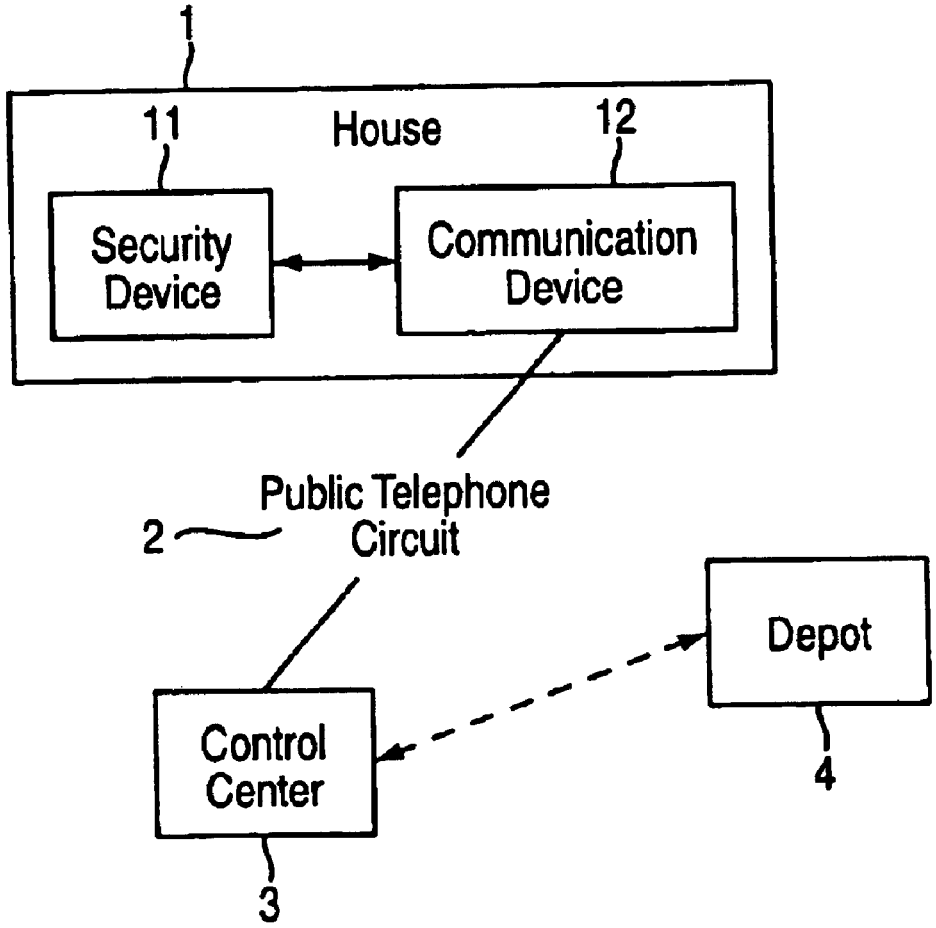
Fig. 1 PRIOR ART
FIG. 1 is a block diagram showing a structural example of a conventional security system.
Figure 2:
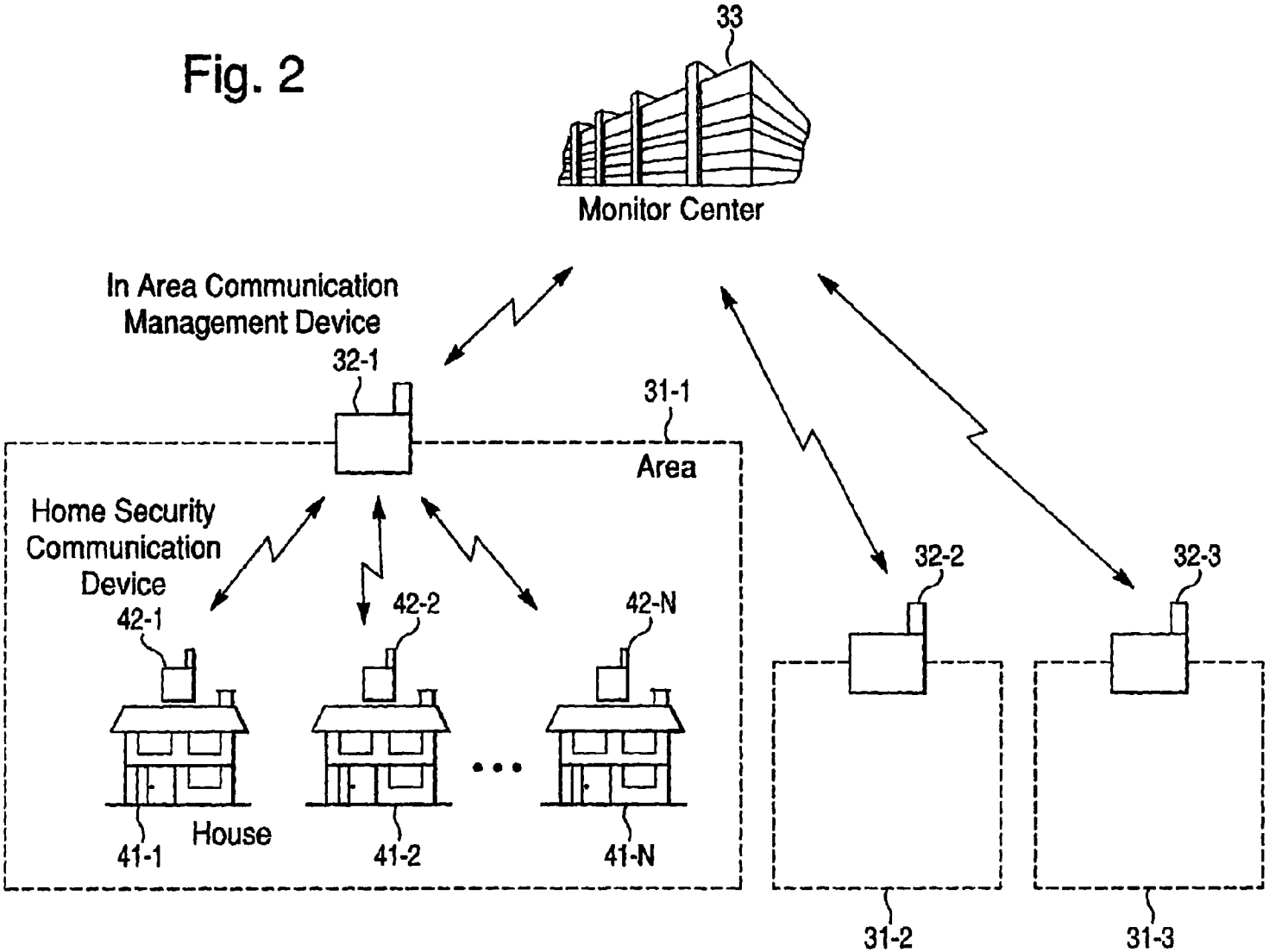
FIG. 2 is a view showing a conception of a security system according to an embodiment of the present invention.

FIG. 2 is a view showing a conception of a security system to which the present invention can be applied. As shown in FIG. 2, an area where houses 41-1 to 41-N (hereinafter, in the case where it is not necessary to individually distinguish the houses 41-1 to 41-N, they are together called "houses 41". The same applies to other structural elements.) exist is set as an area 31-1. Home security communication devices 42-1 to 42-N are installed in the respective houses 41, and the respective home security communication devices 42 communicate with an in-area communication management device 32-1 by a wireless connection.

The in-area communication management device 32-1 communicates with a management center 33 for monitoring the occurrence of unusual situations by a wireless connection.

As shown in the drawing, areas 31-2 and 31-3 having the same structure are set, and in-area communication management devices 32-2 and 32-3 also communicate with the monitor center 33 by a wireless connection similarly to the in-area communication management device 32-1. Each of the areas is set as a range of hundreds of meters in radius or a range of hundreds of houses. The in-area communication management device 32 is installed to a predetermined telephone pole in the area.

Figure 3:
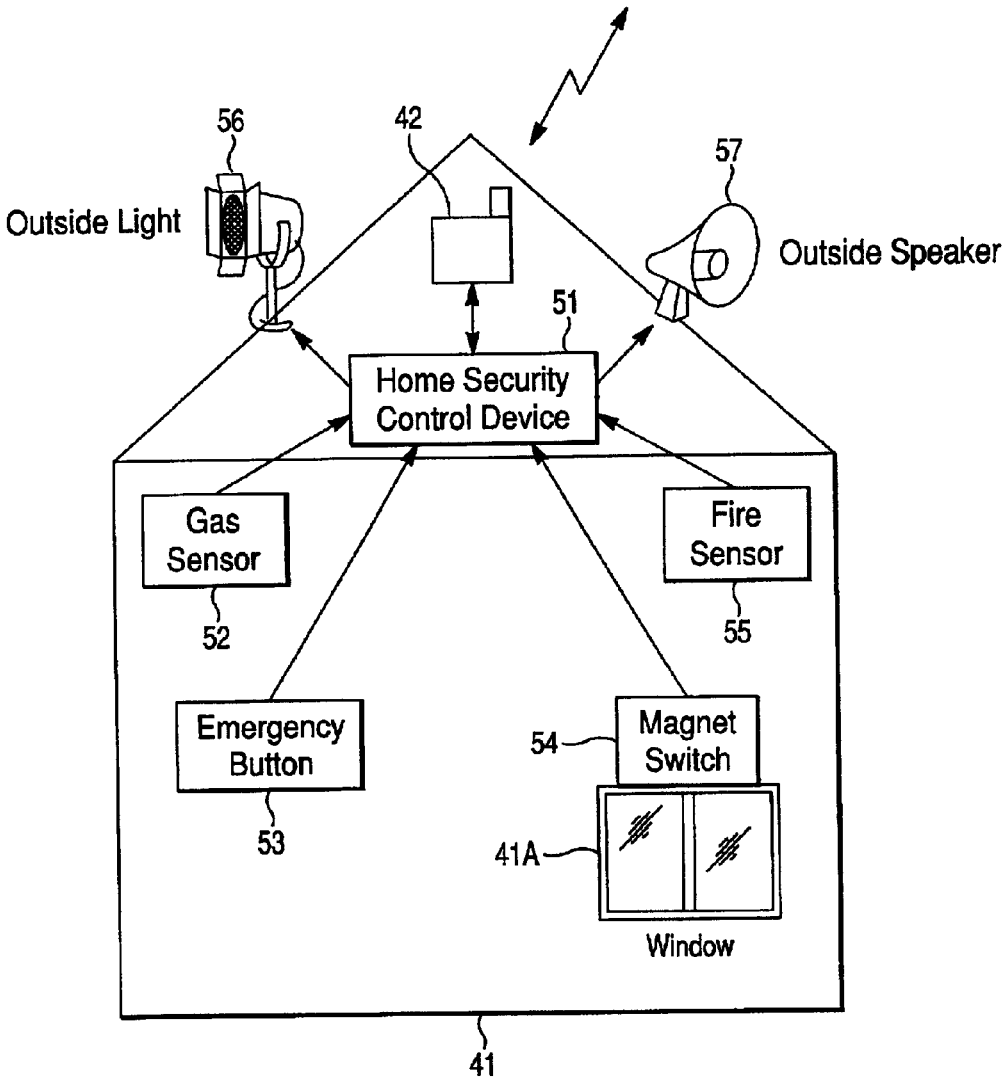
FIG. 3 is a view showing a device installed in a house according to an embodiment of the present invention.

Devices for detecting the occurrence of various unusual situations and the like are connected to the home security communication device 42 installed in each of the houses. FIG. 3 is a view showing an example of the devices which can be installed in each of the houses.

Sensors are installed in respective portions of the house 41 (houses 41-1 to 41-N), and when detecting unusual situations, the respective sensors output them to a home security control device 51. The sensors may include, for example, a gas sensor 52 for detecting gas leakage, an emergency button 53 operated when the resident of the house 41 confirms the occurrence of an unusual situation, a magnet switch 54 for detecting that a key of a window 41A in a closed state is opened or the window 41A is broken though a security mode is on, and/or a fire sensor 55 for detecting the occurrence of a fire. Hereinafter, in the case where it is not necessary to individually distinguish the gas leakage detected by the gas sensor 52, a signal outputted when the emergency button 53 is operated, unusualness of the window 41A detected by the magnet switch 54, and the fire detected by the fire sensor 55, they can generally all be referred to as unusual situations.

The home security control device 51 controls the home security communication device 42, and communicates with the monitor center 33 (after-mentioned center device 82 (see FIG. 5)) through the in-area communication management device 32.

An outside light 56 and/or an outside speaker 57 can be provided at the exterior of the house 41, and as described later, driven on the basis of the control of the house security control device 51, to threaten an intruder or the like.

Figure 4:
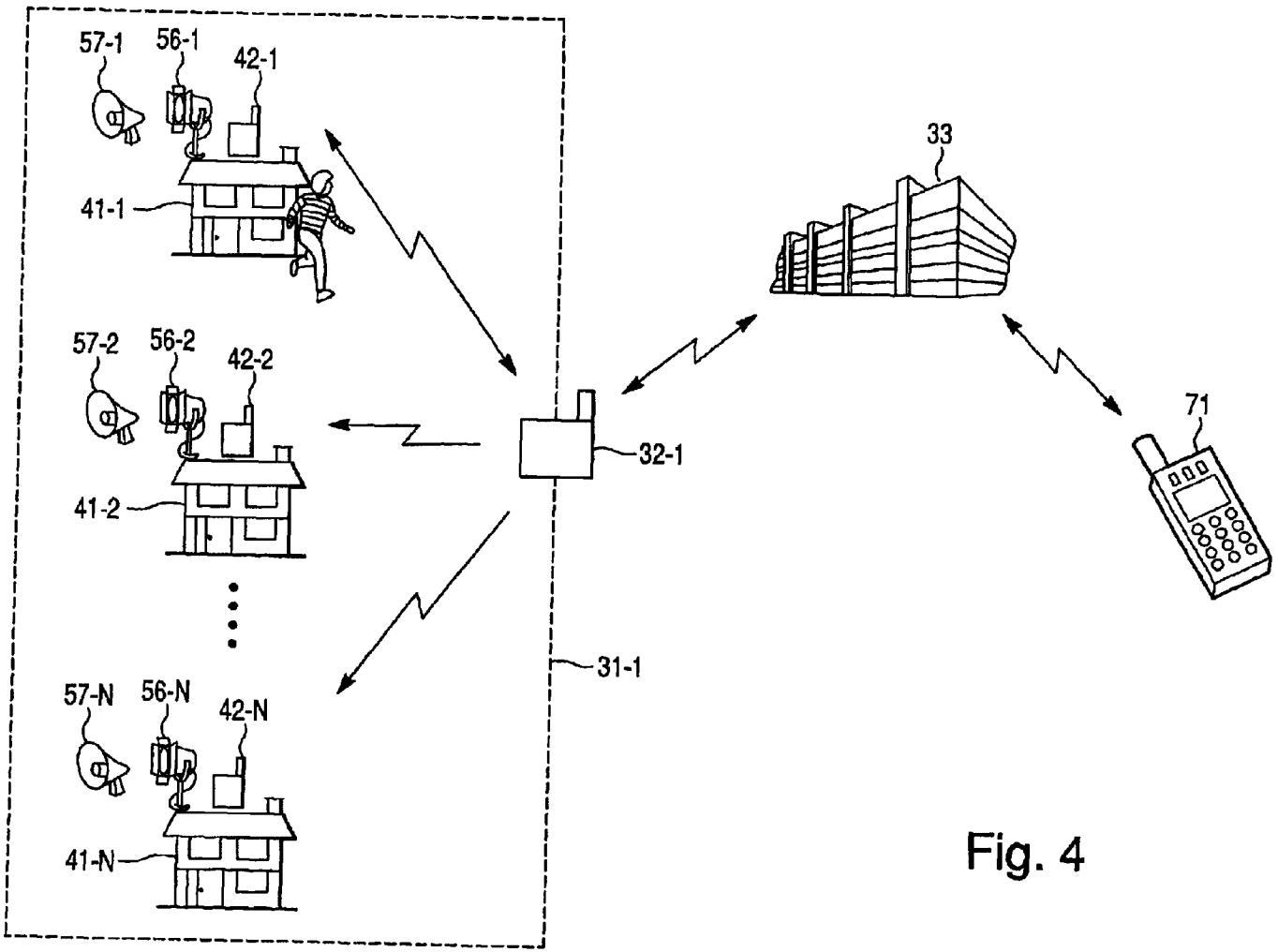
FIG. 4 is a view showing an operation of the security system of FIG. 2 according to an embodiment of the present invention.

FIG. 4 is a view showing an operation of the home security system of FIG. 2. A description will be given of a case where occurrence of an unusual situation is detected in, for example, the house 41-1.

For example, when the magnet switch 54-1 detects the existence of an intruder (sneak thief), the home security control device 51-1 controls the home security communication device 42-1, and notifies the monitor center 33 through the in-area communication management device 32-1 that an unusual situation occurs in the house 41-1.

This notification also includes a device ID or the like of the home security control device 51-1, and the monitor center 33 can recognize that the unusual situation occurs in which house.

When confirming that the unusual situation occurs in the house 41-1, the monitor center 33 notifies a predetermined agency, such as a security company or the police, of the detected unusual situation. The monitor center may also notify a portable telephone 71 of the unusual situation by electronic mail, voice or the like, the portable telephone being previously specified as a notice destination. The portable telephone 71 may be owned by, for example, the resident of the house 41-1. By this, the resident of the house 41-1 can be notified at a remote location that the unusual situation occurs in the house, and can go back to the house to confirm the unusual situation.

The monitor center 33 also notifies the home security devices 51-2 to 51-N installed in the other houses 41-2 to 41-N in the area 31-1 that the unusual situation occurs in the house 41-1.

Each of the home security control devices 51-2 to 51-N receiving this notification outputs the information of the occurrence of the unusual situation in the house 41-1 onto a display portion or the like, and causes the resident of each house to confirm it. By this, the neighbor residents of the house 41-1 can also confirm that the unusual situation occurs in the house 41-1, and respond accordingly. For example, measures can be taken such that the neighbor residents cooperate with one another to arrest a sneak thief who intruded into the house 41-1, or lock unlocked doors to prevent the damage from befalling to their own houses.

Furthermore, in response to the instruction from the monitor center 33, outside lights 56-1 to 56-N and/or outside speakers 57-1 to 57-N installed in the respective houses 41-1 to 41-N in the area 31-1 can be driven. By this, for example, in the case where the surroundings are dark, the whole area 31-1 is brightened, and the spread of the damage can be suppressed. Moreover, when an alarm to give warning is outputted, a person walking in the surroundings can take measures to protect themselves, such as going away from the place.

Figure 5:
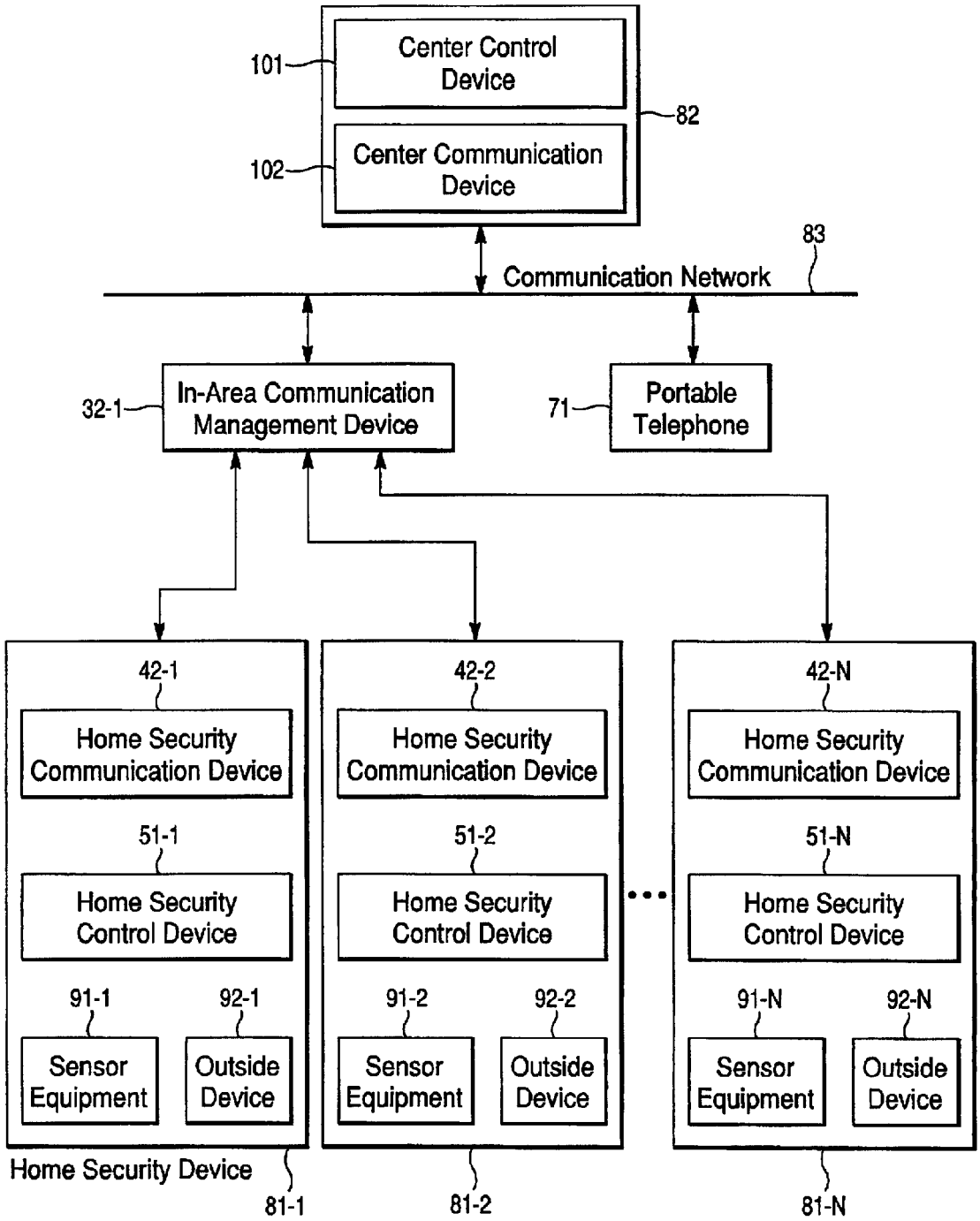
FIG. 5 is a block diagram showing a structural example of the security system of FIG. 2 according to an embodiment of the present invention.

FIG. 5 is a block diagram showing a structural example of the foregoing security system.

A home security device 81-1 is a device installed in the house 41-1, and includes by the foregoing home security communication device 42-1, the home security control device 51-1, a sensor equipment 91-1 comprising the gas sensor 52-1, a fire sensor 55-1, and/or an outside device 92-1 including outside light 56-1 and/or outside speaker 57-1.

Home security devices 81-2 to 81-N are respectively installed in the houses 41-2 to 41-N, and are similar to the home security device 81-1.

The in-area communication management device 32-1 communicates with the home security devices 81-1 to 81-N by a wireless connection, and realizes communication relating to the occurrence of an unusual situation, the output of an alarm, and the like as described above through a communication network 83 (e.g., via a wireless communication network).

The center device 82 includes a center control device 101 and a center communication device 102. The center control device 101 controls the center communication device 102, communicates with the home security devices 81-1 to 81-N, and notifies, for example, the portable telephone 71 owned by the resident of the house 41-1 that an unusual situation occurs in the house. Although only the portable telephone 71 owned by the resident of the house 41-1 is shown in the drawing, portable telephones owned by residents of the houses 41-2 to 41-N are also connected to the communication network 83.

Figure 6:
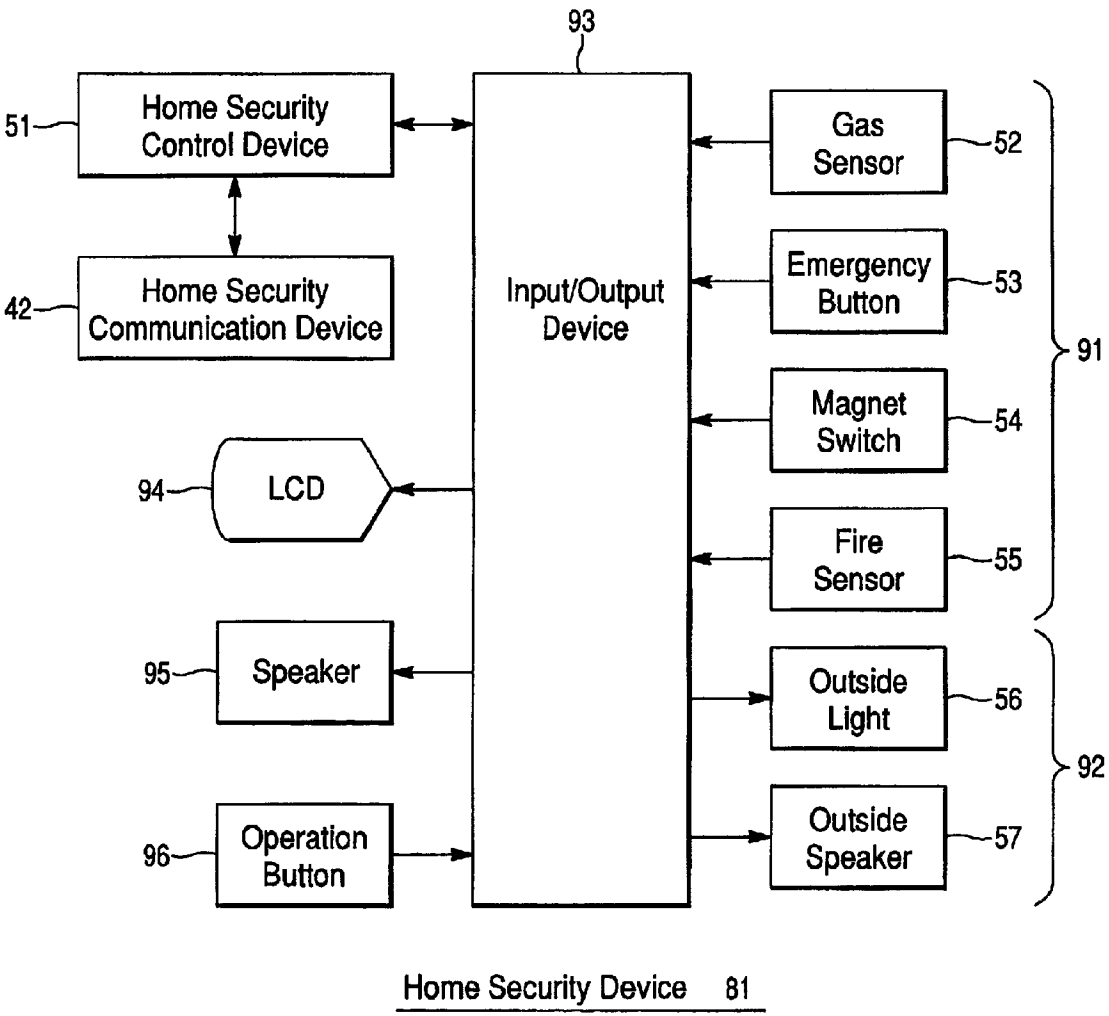
FIG. 6 is a block diagram showing a detailed structural example of a home security device of FIG. 5 according to an embodiment of the present invention.

FIG. 6 is a block diagram showing a detailed structural example of the home security device 81. The home security device 81 includes, an LCD (Liquid Crystal Display) 94, a speaker 95 installed in the interior of the house differently from the outside speaker 57, and/or an operation button 96 operated when various operations are inputted to the home security device 81. The home security control device 51 receives an output of a sensor 91 through an input/output device 93 and controls an operation of an outside equipment 92.

Figure 7:
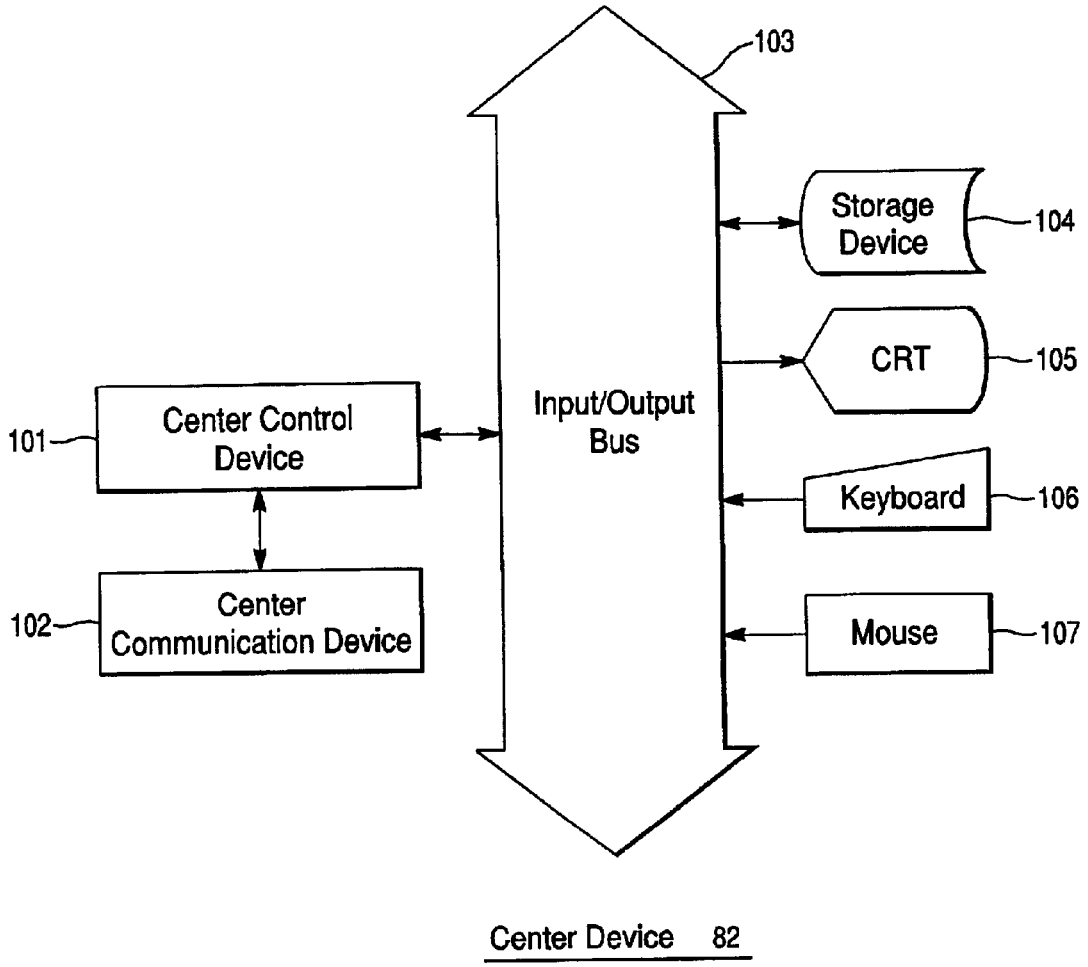
FIG. 7 is a block diagram showing a detailed structural example of a center device of FIG. 5 according to an embodiment of the present invention.

FIG. 7 is a block diagram showing a structural example of the center device 82. The center control device 101 substantially controls the whole operation of the center device 82 through an input/output bus 103. A storage portion 104 stores various pieces of information, such as, for example, a telephone number of a portable telephone as a notice destination to which notice that an unusual situation occurs in the house is given, correspondingly to the device ID of the home security device 81 installed in every house. A CRT (Cathode Ray Tube) 105 displays map information of the neighborhood of the occurrence place and the like on the basis of the control of the center control device 101 when the occurrence of the unusual situation is notified from any one of the home security devices 81, and exhibits it to a manager the center device 82. A keyboard 106 and a mouse 107 are operated by the manager of the center 82, and outputs a signal corresponding to the operation content to the center control device 101 through the input/output bus 103.

Figure 8:
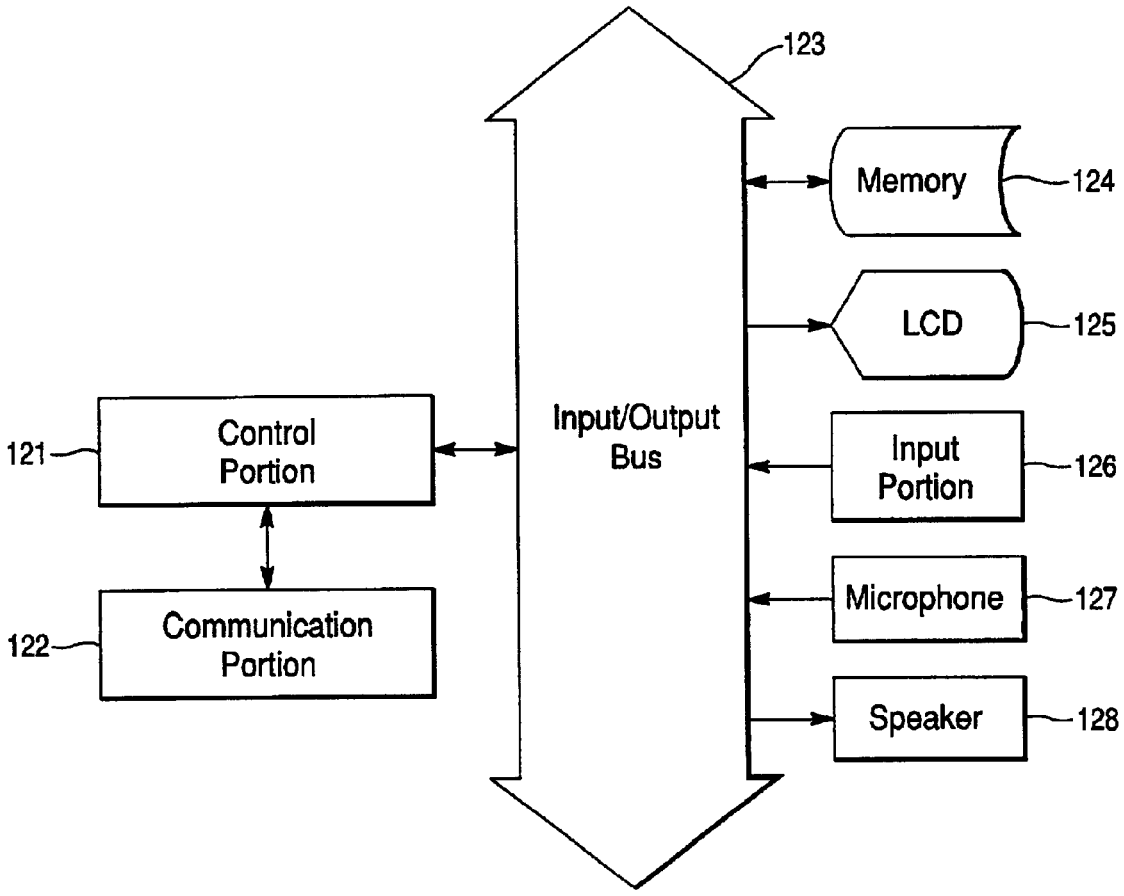
FIG. 8 is a block diagram showing a detailed structural example of a portable telephone of FIG. 5 according to an embodiment of the present invention.

FIG. 8 is a block diagram showing a structural example of the portable telephone 71. A control portion 121 controls each portion through an input/output bus 123, and substantially controls the whole operation of the portable telephone 71. A communication portion 122 communicates with various devices through the communication network 83, and outputs a received packet to the control portion 121. A memory 124 is formed including nonvolatile flash memory or the like, and stores information such as the registered telephone number and further stores, for example, electronic mail which is transmitted from the center device 82 and gives notice of the occurrence of the unusual situation. An LCD 125 displays various pieces of information on the basis of the instructions from the control portion 121. For example, a message to give notice that the unusual situation occurs in the house, or the like is displayed on the LCD 125. An input portion 126 is composed of a ten-key keypad, a cross key keypad or the like, and receives an input from the user of the portable telephone 71. A microphone 127 and a speaker 128 operate when the control portion 121 executes a communication mode. The microphone 127 collects words of the user of the portable telephone 71 to output them through the input/output bus 123 to the control portion 121. When receiving voices transmitted from another telephone or the like through the input/output bus 123 and through the control portion 121, the speaker 128 outputs it.

Figure 9:
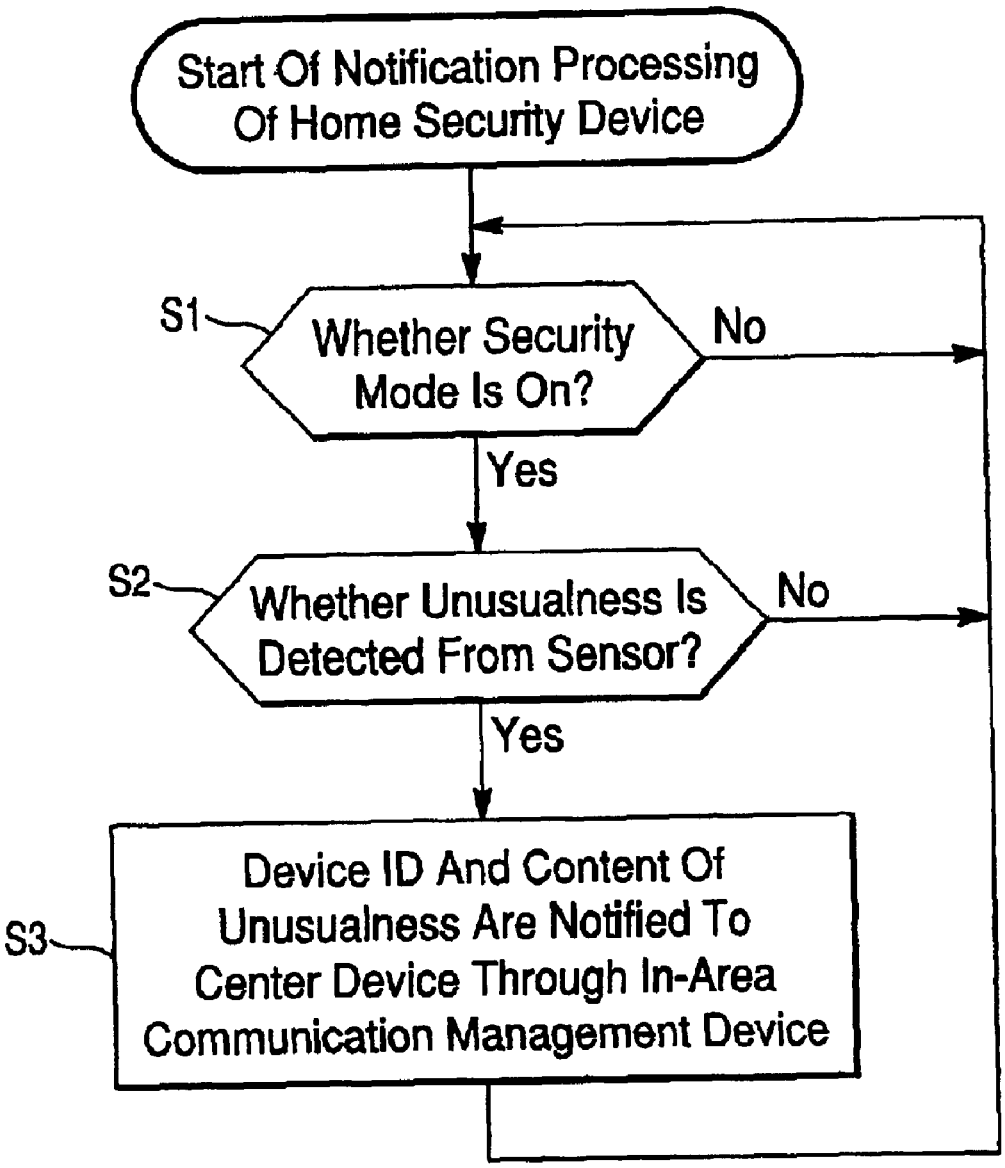
FIG. 9 is a flowchart for explaining a processing of a security device according to an embodiment of the present invention.

Next, an operation of a security system according to an embodiment of the present invention will be described. First, a notification processing of the home security device 81 will be described with reference to the flowchart of FIG. 9.

At step S1, the home security control device 51 judges whether or not a security mode is on, and waits until it judges that the mode is on. As will be described later, the resident of each of the houses can change the security mode of his own house by, for example, operating the operation button 96 or accessing a predetermined setting page by his own portable telephone.

When the home security control device 51 judges that the security mode is on, it proceeds to step S2, judges whether or not unusualness is detected by the sensor equipment 91, returns to the step S1 until it judges that unusualness is detected, and carries out the subsequent processing repeatedly.

When the home security control device 51 judges at the step S2 that the sensor equipment 91 detects an unusual situation, it proceeds to step S3, and transmits a device ID of the home security control device 51 and the contents of the detected unusualness (for example, information as to which sensor detects the unusualness) to the center device 82 through the in-area communication management device 32. Then, it returns to the step S1, and the subsequent processing is repeatedly carried out.

Figure 10:
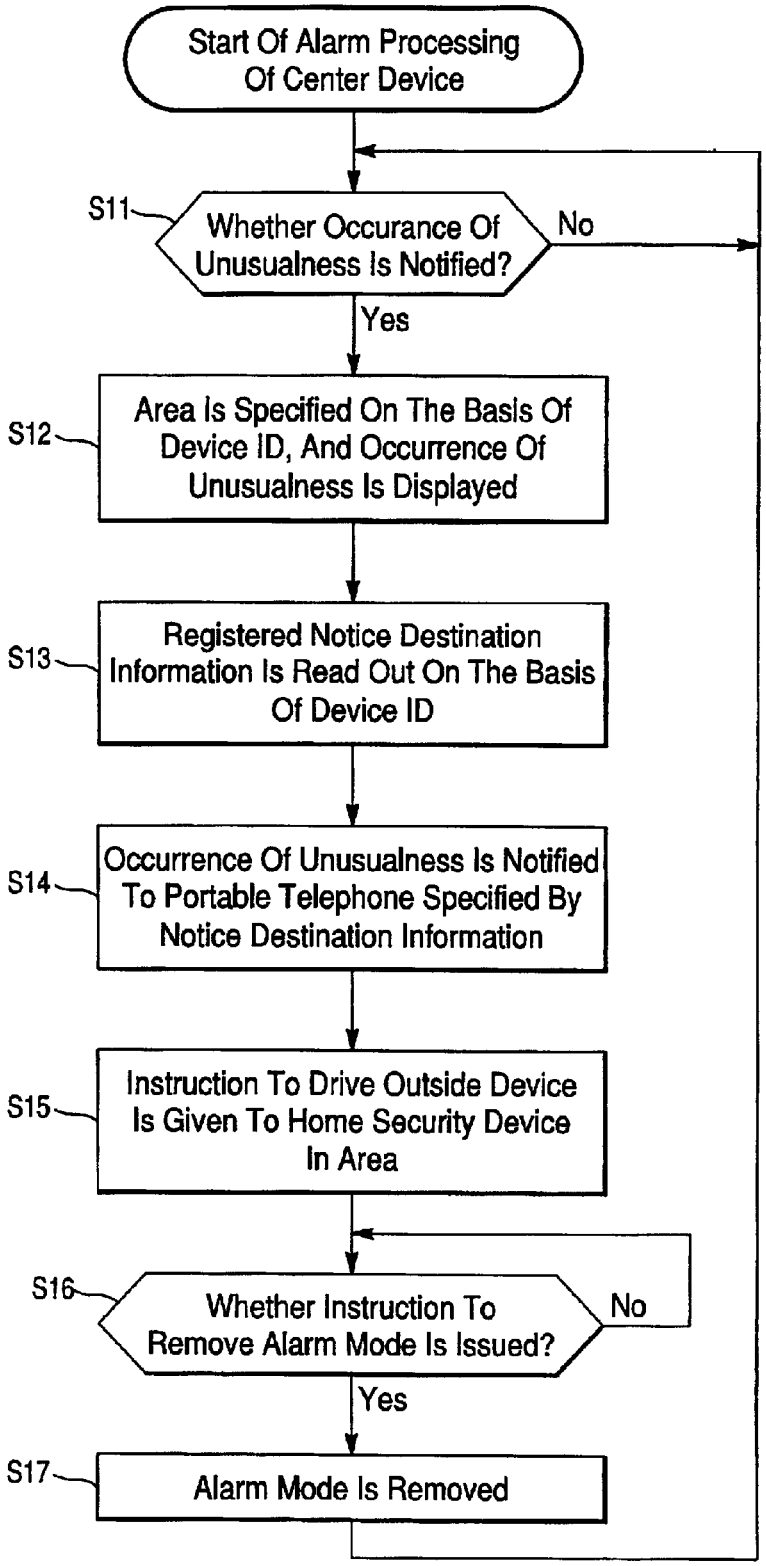
FIG. 10 is a flowchart for explaining a processing of a center device according to an embodiment of the present invention.

Next, an alarm processing of the center device 82 will be described with reference to the flowchart of FIG. 10.

At step S11, on the basis of the output from the center communication device 102, the center control device 101 judges whether or not the occurrence of unusualness is notified from any one of the home security devices 81, and waits until it judges that the occurrence of the unusualness is notified.

On the other hand, at the step S11, in the case where the center device 101 judges that the occurrence of the unusualness is notified, it activates an alarm mode, proceeds to step S12, specifies the house where the unusualness occurs and the area including the house on the basis of the device ID included in the notified information, and displays them, together with a message to urge the manger to confirm the occurrence of the unusualness, on the CRT 105.

Figure 11:
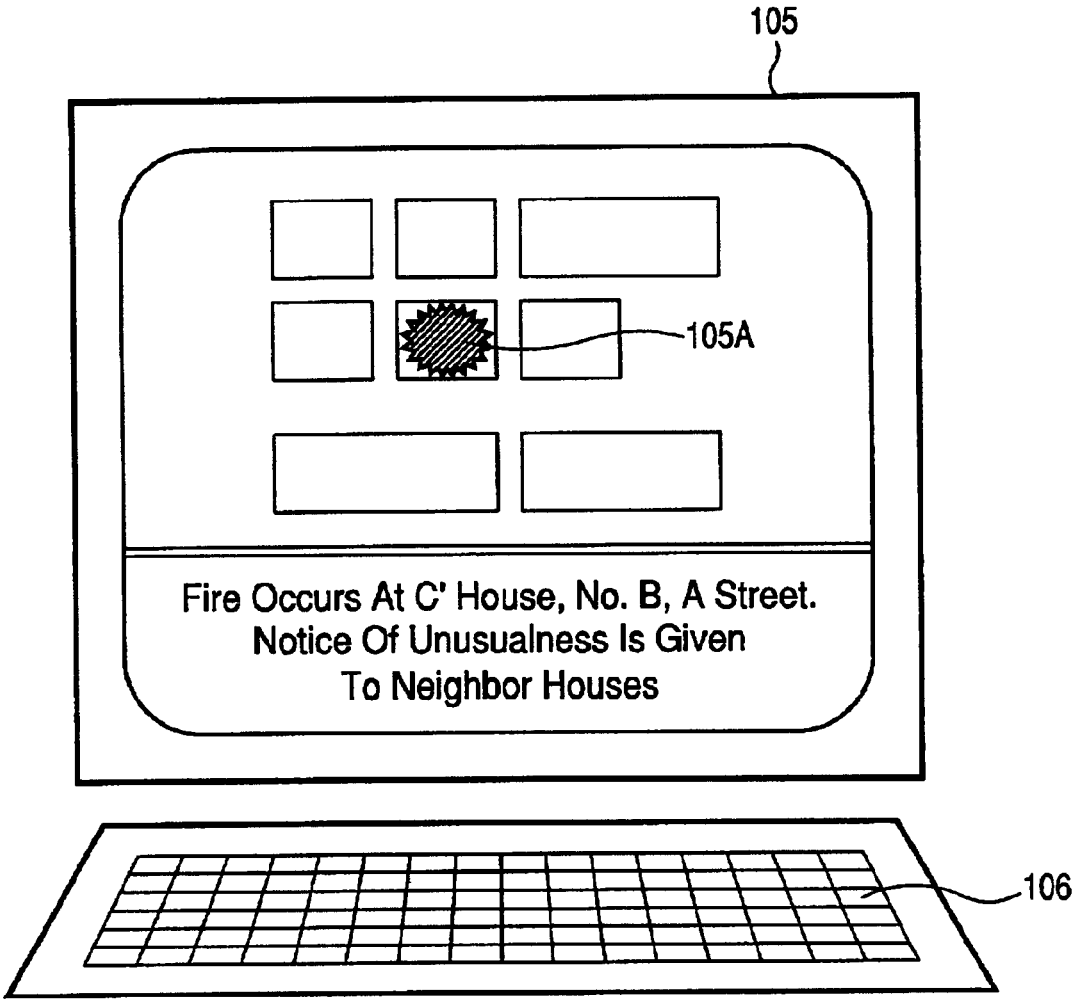
FIG. 11 is a view showing a display example of a center device according to an embodiment of the present invention.

FIG. 11 is a view showing a display example of the CRT 105, and this example shows the case where the occurrence of a fire is detected by the fire sensor 35.

As shown in the drawing, the map of a neighbor area including the house where the occurrence of the fire is detected is displayed, and the house where the fire occurs is specified by a pointer 105A. Then, as the message to the manager of the center device 82, "Fire occurs at C' house, No. B, A Street. Notice of the unusualness is given to neighbor houses." is displayed. The manager confirms this message, accesses the home security device 81 of the house which sent the information, and carries out a predetermined processing such as confirmation of whether the resident is at home.

At step S13, on the basis of the notified device ID, the center control device 101 reads out the registered notice designation specifying information from the storage device 104. That is, it may be necessary for the user using the security system to previously register the telephone number of the personally used portable telephone, the mail address or the like as the notice destination to which information is sent when an unusual situation occurs in his own house. Incidentally, in addition to the portable telephone, a mail address of a PHS terminal, a personal computer, a PDA or the like can be registered as a notice destination.

Then, at step S14, the center control device 101 transmits information including a message to give notice that the occurrence of the unusual situation is detected in the house, to the portable telephone 71 specified by the notice destination specifying information read out at the step S13. This information is outputted from the center communication device 102, and is transmitted to the portable telephone 71 through the communication network 83.

At step S15, the center control device 101 notifies the other home security devices 81 in the area including the house where the occurrence of the unusual situation is detected that the unusual situation occurs in the vicinity. For example, the center control device 101 causes a message giving caution to be displayed on the LCD 94 of the home security device 81, and issues an instruction to drive the outside device 92.

For example, in the case where the occurrence of the fire is detected in the home security device 81-1 installed in the house 41-1, the instruction is given to the home security devices 81-2 to 81-N. On the LCD 94 of each of the home security devices 81-2 to 81-N, for example, a message "There is a fear that a fire occurs in the house 41-1. Please take precautions," is displayed. Further, voice guidance indicating the same contents is outputted by the outside speaker 57, and the surroundings are irradiated by the outside light 56. The outside device 92-1 installed in the house 41-1 is also driven in a similar manner.

At step S16, the center control device 101 judges whether or not an instruction to remove the alarm mode is issued from the portable telephone 71 used by the resident of the house where the occurrence of the unusual situation is detected. That is, the user who confirms through the portable telephone 71 that the occurrence of the unusual situation is detected in the house, goes back to the house and confirms the state. Then, the user who confirmed that, for example, the unusual situation such as the fire was solved, or that it was an erroneous operation of a sensor, instructs the center device 82 to remove the alarm mode through the portable telephone 71.

The center control device 101 continues to output the alarm until the instruction to remove the alarm mode is issued from the portable telephone 71. In the case where it judges that the instruction to remove the alarm mode is issued, it proceeds to step S17 and removes the alarm mode. By this, for example, the activation of the outside lights 56 and the outside speakers 57 of the houses in the area 31-1 is stopped. Thereafter, it returns to the step S1, and the subsequent processing is repeatedly carried out.

Figure 12:
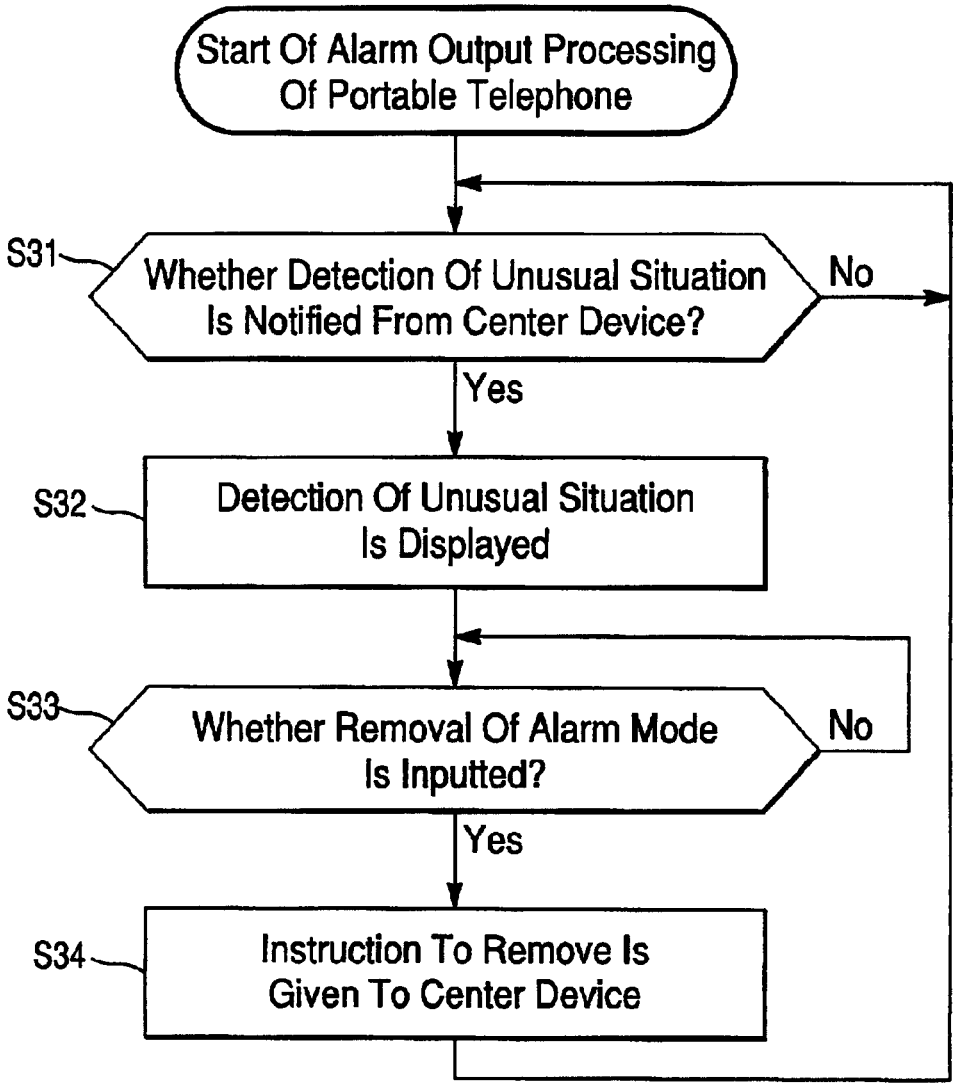
FIG. 12 is a flowchart for explaining a processing of the portable telephone according to an embodiment of the present invention.

Next, an alarm output processing of the portable telephone 71 will be described with reference to the flowchart of FIG. 12.

At step S31, on the basis of the output from the communication portion 122, the control portion 121 judges whether or not the detection of the unusual situation in the house is notified from the center device 82, and waits until a judgment that it is notified is made.

At the step S31, in the case where the control portion 121 judges that the detection of the unusual situation is notified, it proceeds to step S32, controls the LCD 125 through the input/output bus 123, and displays a message that the unusual situation is detected in the house.

Figure 13:
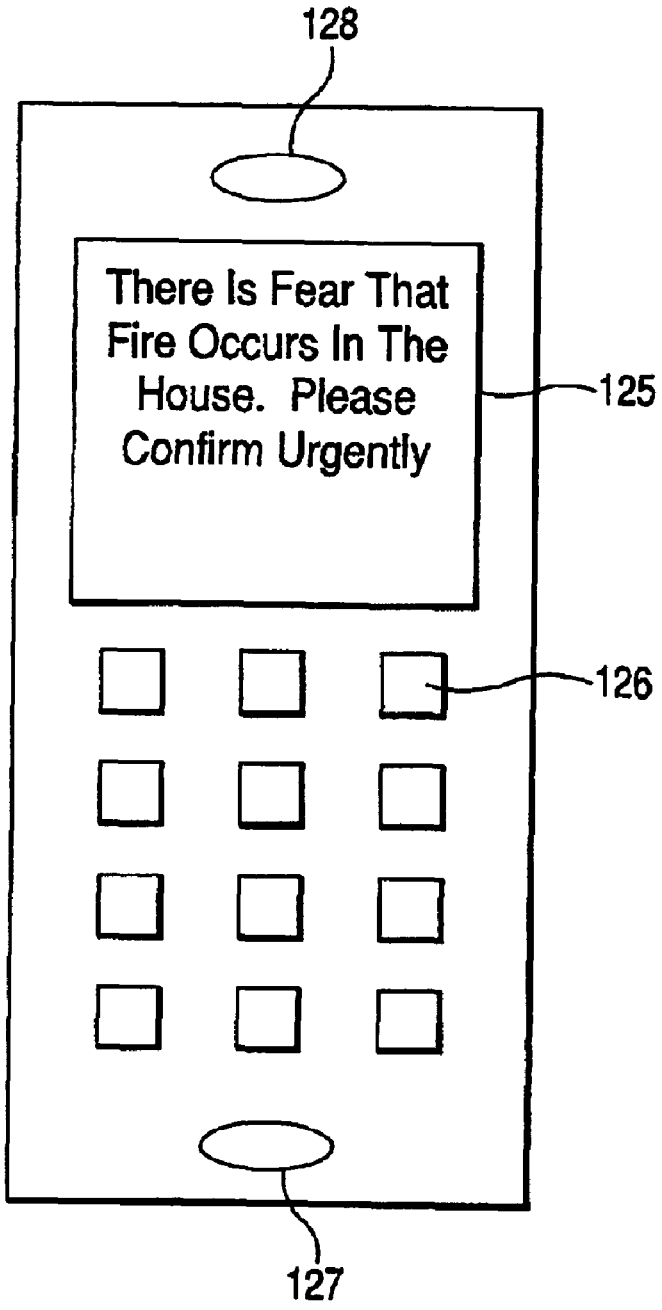
FIG. 13 is a view showing a display example of the portable telephone according to an embodiment of the present invention.

FIG. 13 is a view showing an example of the message displayed at the step S32. As shown in the drawing, for example, the message "There is a fear that a fire occurs in the house. Please confirm urgently." is displayed.

The user who confirms this message, for example, goes back to the house, confirms the state of the fire, and takes appropriate action.

At step S33, the control portion 121 judges whether or not the instruction to remove the alarm mode is inputted from the user to the center device 82 on the basis of the output from the input portion 126, and waits until it judges that the removal is inputted. Then, in the case where the control portion 121 judges that the removal of the alarm mode is inputted, it proceeds to step S34, controls the communication portion 122, and instructs the center device 82 to remove the alarm mode through the communication network 83. Thereafter, the processing is returned to the step S31, and the subsequent processing is repeatedly carried out.

Figure 14:
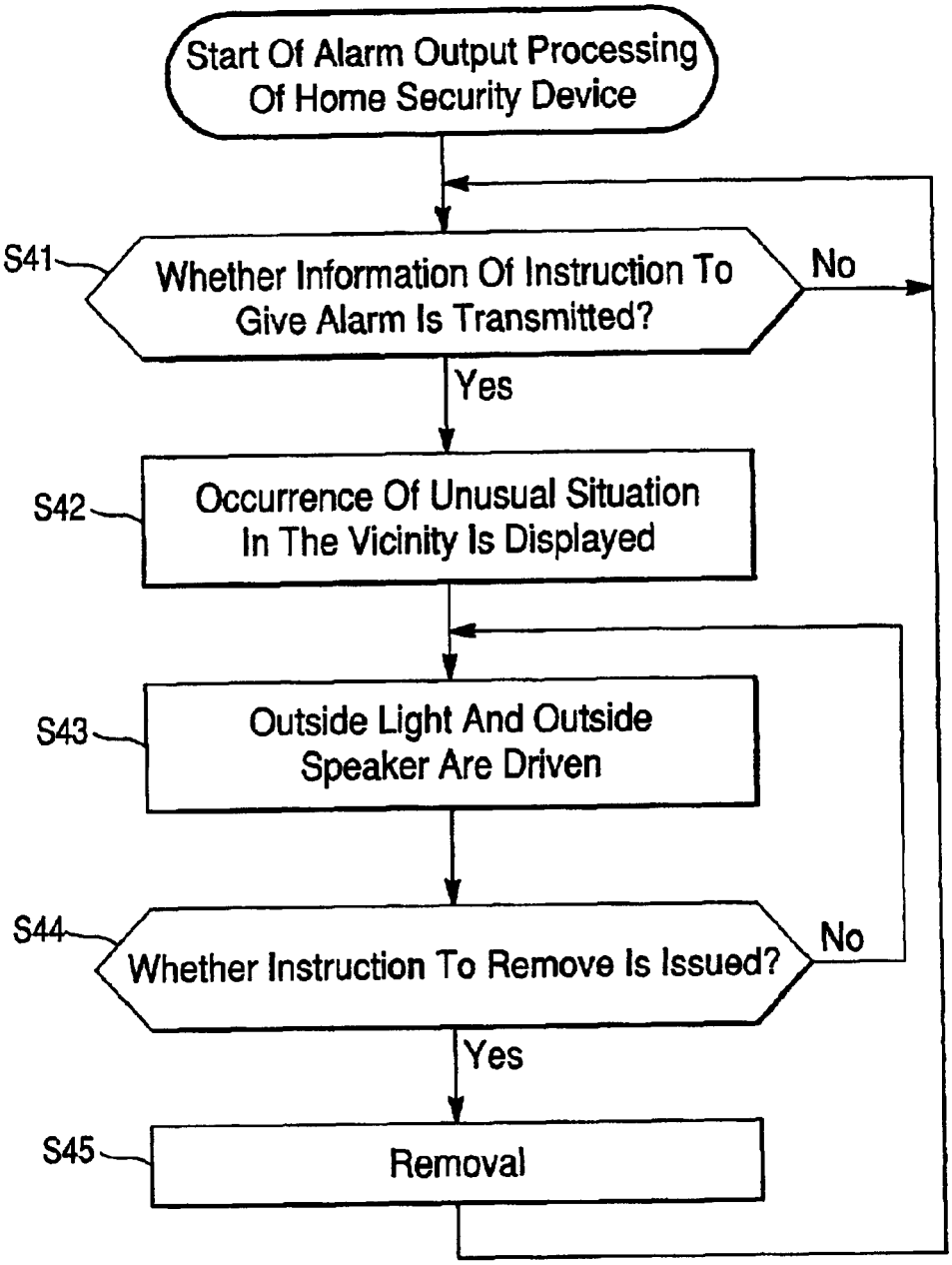
FIG. 14 is a flowchart for explaining a processing of the home security device according to an embodiment of the present invention.

Next, an alarm output processing of the home security device 81 installed in the house in the vicinity of the house where the occurrence of the unusual situation is detected, will be described with reference to the flowchart of FIG. 14.

At step S41, on the basis of the output from the home security communication device 42, the home security control device 51 judges whether or not information of an instruction to give an alarm is transmitted from the center device 82, and waits until a judgment that it is transmitted is made. In the case where the home security control device 51 judges that the information of the instruction to give the alarm is transmitted from the center device 82, it activates an alarm mode, proceeds to step S42, and displays a message on the LCD 94 to urge residents to confirm that the unusual situation occurs in the vicinity.

Figure 15:
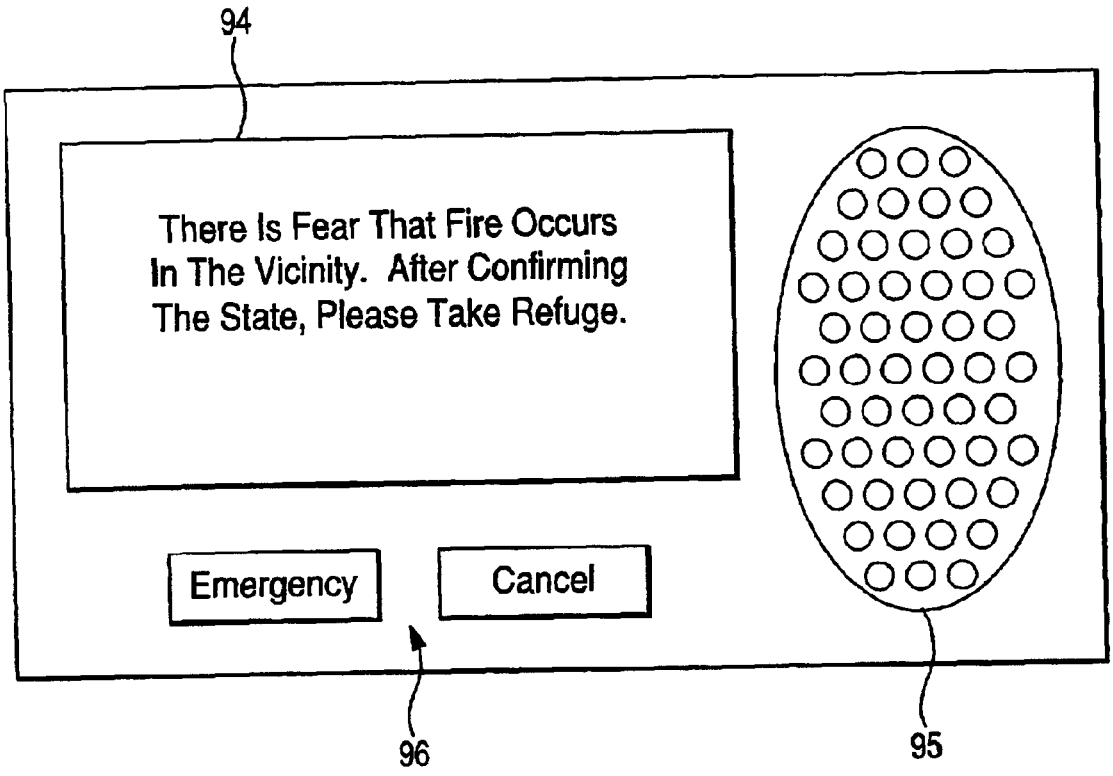
FIG. 15 is a view showing a display example of the home security device according to an embodiment of the present invention.

FIG. 15 is a view showing an example of the message displayed at the step S42. As shown in the drawing, for example, the message "There is a fear that a fire occurs in the vicinity. After confirming the state, please take refuge." is displayed. Furthermore, a predetermined alarm sound is outputted from the speaker 95.

At step S43, the home security control device 51 drives the outside light 56 and the outside speaker 57. By this, an alarm having the same contents as the message as shown in FIG. 15 is outputted from the outside speaker 57, and the surroundings are irradiated by the outside light 56.

At step S44, the home security control device 51 judges whether or not an instruction to remove the alarm mode is issued from the center device 82, returns to the step S43 until the instruction to remove is issued, and drives the outside device 92. In the case where the home security control device 51 judges that the instruction to remove the alarm mode is issued, it proceeds to step S45 and removes the alarm mode. Thereafter, the processing is returned to the step S41, and the subsequent processing is repeatedly carried out or reduced.

As described above, when the occurrence of the unusual situation is detected, since the alarm is also given to the neighbor residents (i.e., other than just to the resident of the house), the neighbor residents hearing the alarm can deal with the unusual situation, and the spread of damage can be prevented or reduced.

Figure 16:
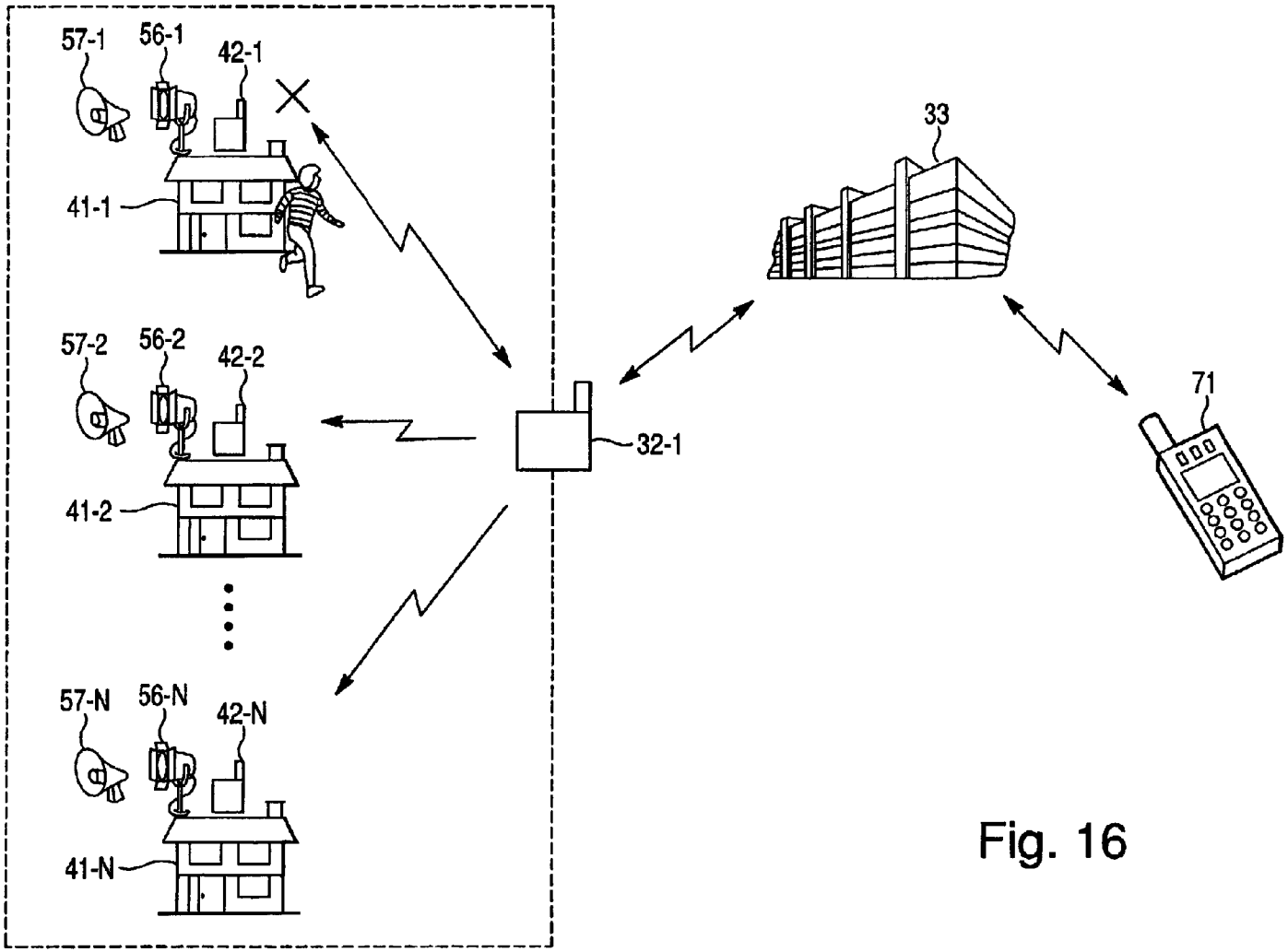
FIG. 16 is a view showing a conception of another home security system to which the present invention is applied according to an embodiment of the present invention.

FIG. 16 is a view showing a conception of another security system according to an embodiment of the present invention. In this security system, the monitor center 33 examines whether the home security device 81 installed in each house is operating normally.

When a device which is operating abnormally is detected, the monitor center 33 notifies a notice destination such as a portable telephone owned by the resident of the house that the home security device 81 of the house is operating abnormally, and similarly notifies neighbor residents that the home security device 81 which is operating abnormally is confirmed in the area.

Thus, as shown in the drawing, for example, in the case where the home security communication device 42-1 installed in the house 41-1 is broken by someone, it is possible to prevent the damage from befalling to the other home security device 81 existing in the area 31-1.

Figure 17:
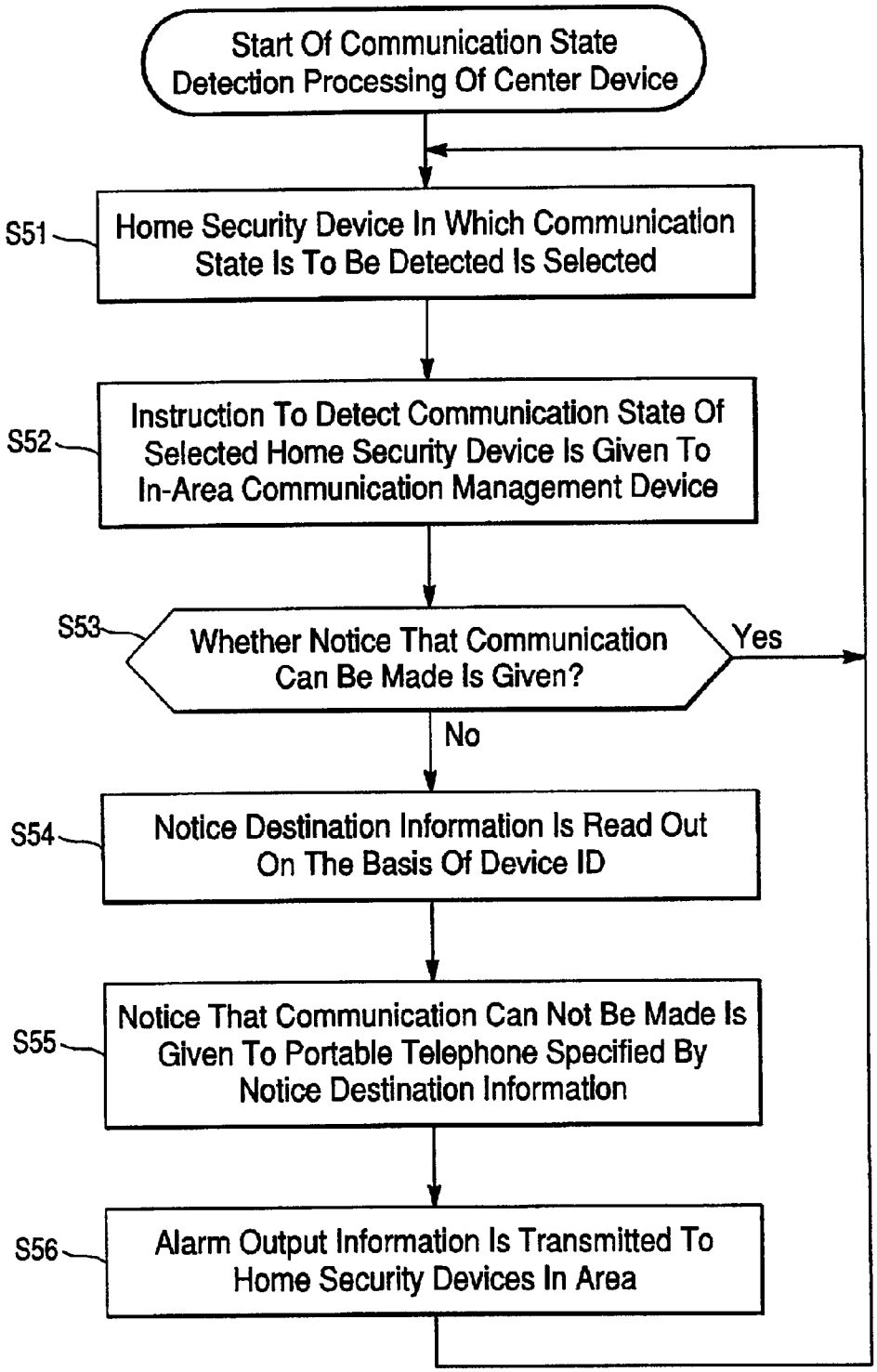
FIG. 17 is a flowchart for explaining another processing of a center device according to an embodiment of the present invention.

First, a communication state detection processing of the center device 82 will be described with reference to the flowchart of FIG. 17.

At step S51, the center control device 101 confirms the state of each of the home security devices 81 stored in the storage device 104, and selects the home security device 81 the communication state of which is to be detected, from the devices in which the security mode is operating in an on state. At step S52, the center control device 101 notifies the in-area communication management device 32 of information relating to the selected home security device 81, and issues an instruction to detect the communication state.

The in-area communication management device 32 accesses the home security device 81 in response to this instruction, judges whether or not it is operating abnormally, and outputs the judgment result to the center device 82. At step S53, on the basis of the output from the in-area communication management device 32, the center control device 101 judges whether or not notice that the home security device 81 selected at the step S51 can communicate is given. In the case where the communication management device 32 judges that communication can be made, the processing returns to the step S51, and the subsequent processing is repeatedly carried out.

On the other hand, at step S53, in the case where the center control device 101 judges that the home security device is not in a state in which it can communicate (i.e., communication can not be made), the center control device 101 proceeds to step S54, and reads out the notice destination specifying information previously registered as the notice destination from the storage device 104. At step S55, the center control device 101 gives notice that the home security device 81 of the house is in a state where it can not communicate, to the portable telephone 71 of the notice destination.

Figure 18:
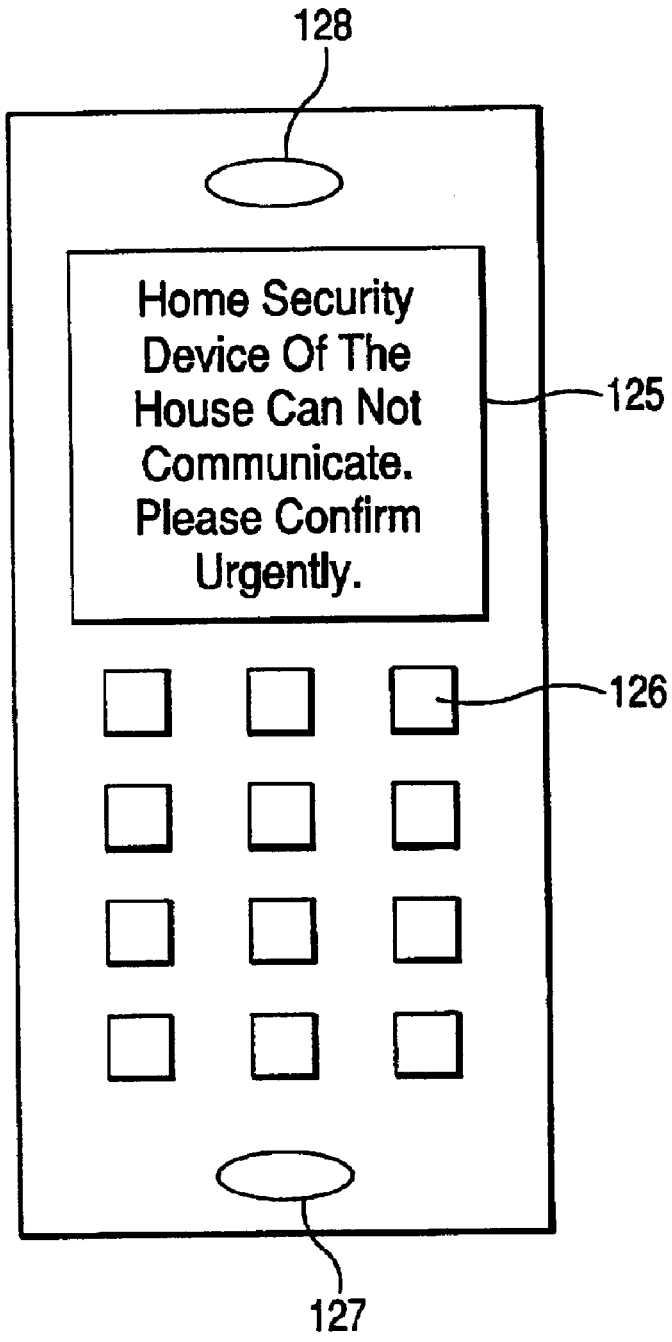
FIG. 18 is a view showing another display example of a portable telephone according to an embodiment of the present invention.

FIG. 18 is a view showing an example of a message outputted to the portable telephone 71 by the processing of the step S55. As shown in the drawing, for example, the message "The home security device of the house can not communicate. Please confirm urgently." is displayed. The user who observes this display goes back to the house, and confirms the state of the home security device 81. For example, in the case where the home security communication device 42 has been broken by an intruder, or a processing to cut off transmission of an electric wave has been carried out, the damage can thus be suppressed to a minimum.

At step S56, the center control device 101 notifies the other home security devices in the area that the home security device 81 which is unable to communicate is confirmed in the neighbor house.

For example, in the case where the home security communication device 42-1 of the house 41-1 is broken by someone, the notice is given to the portable telephone 71 owned by the resident of the house 41-1, and as described above, the message giving caution is also displayed to the residents of the houses 41-2 to 41-N. Furthermore, the outside device 92 may also be driven. Thereafter, the processing is returned to the step S51, and the subsequent processing is repeatedly carried out. Damage due to a broken home security communication device 42 in the neighbor area can thus be suppressed.

Figure 19:
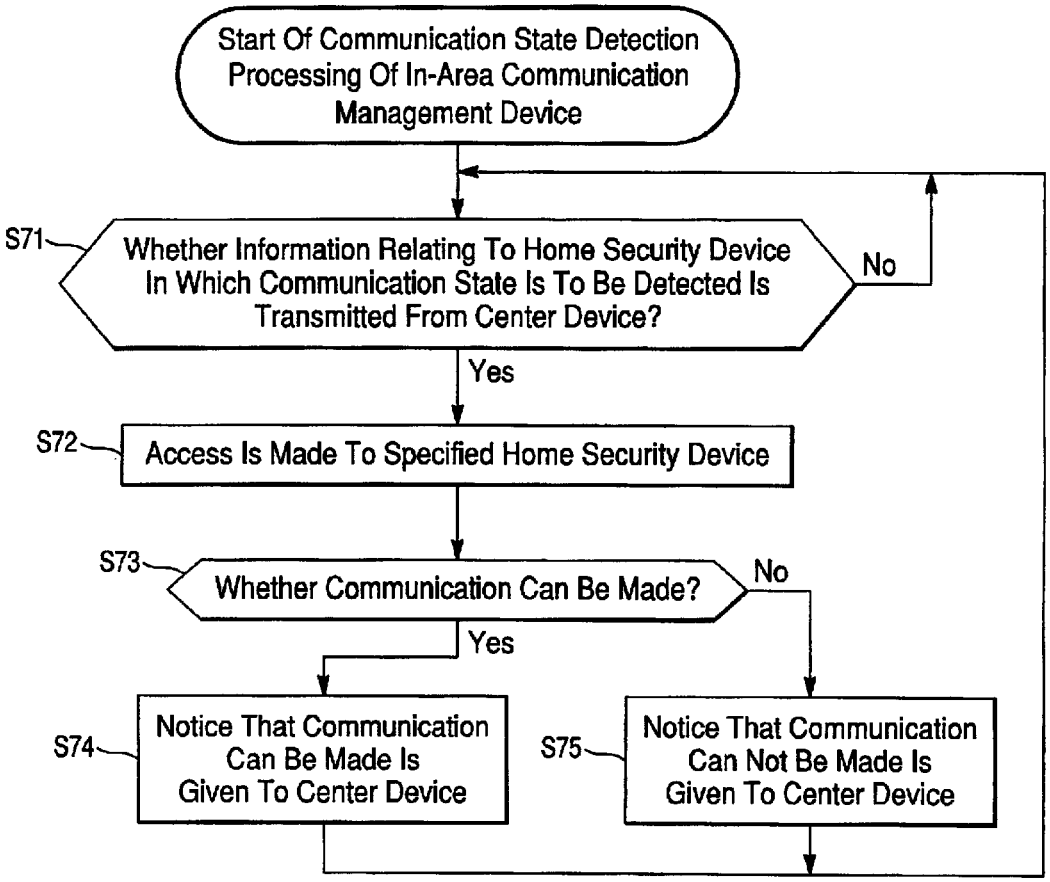
FIG. 19 is a flowchart for explaining an processing of an in-area communication management device according to an embodiment of the present invention.

Next, a communication state detection processing of the in-area communication management device 32 will be described with reference to the flowchart of FIG. 19.

At step S71, the in-area communication management device 32 judges whether or not information relating to the home security device 81 the communication state of which is to be detected is transmitted from the center device 82 through the communication network 83, and waits until a judgment that it is transmitted is made. In the case where the judgment that it is transmitted is made, the in-area communication management device 32 proceeds to step S72, and accesses the specified home security device 81.

At step S73, as a result of the access, the in-area communication management device 32 judges whether or not the home security device 81 can communicate, and in the case where a judgment that it can communicate is made, the in-area communication management device 32 proceeds to step S74, and notifies the center device 82 that the specified home security device 81 can be accessed.

On the other hand, at the step S73, in the case where the in-area communication management device 32 judges that the specified home security device 81 can not communicate, it proceeds to step S75, and notifies the center device 82 that it can not communicate. Thereafter, in the center device 82, the alarm is given to the portable telephone 71.

Figure 20:
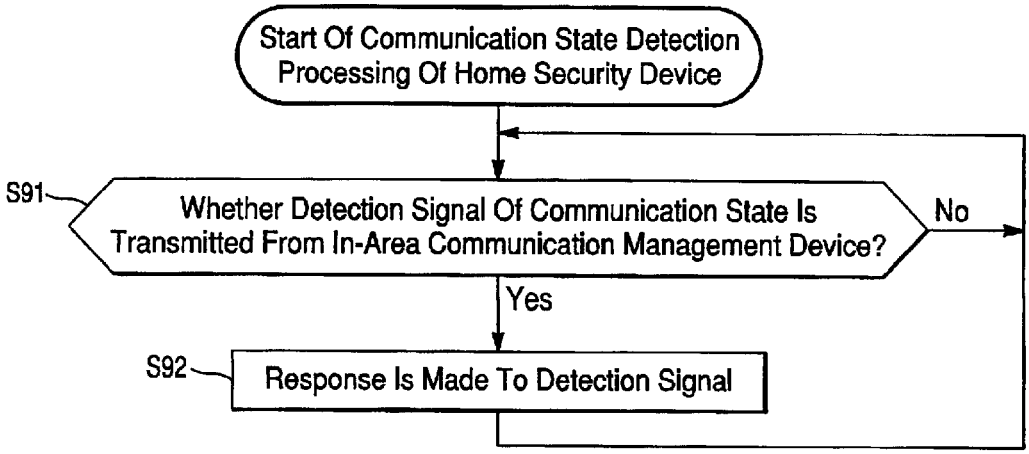
FIG. 20 is a flowchart for explaining another processing of a home security device according to an embodiment of the present invention.

Next, a communication state detection processing of the home security device 81 will be described with reference to the flowchart of FIG. 20.

At step S91, the home security control device 51 judges whether or not a detection signal of a communication state is transmitted from the in-area communication management device 32, and waits until a judgment that it is transmitted is made. In the case where the judgment that it is transmitted is made, the home security control device proceeds to step S92 and responds to it.

By this series of processings, the center device 82 can detect whether or not the selected home security device can communicate. In the case where a confirmation that it can not communicate is made, since the alarm is given to the resident of the house where the home security device 81 is installed and the neighbor residents, the damage can be suppressed to a minimum.

As described above, the user (i.e., a resident) can set the security mode of the home security device 81 of the house by using the portable telephone 71 owned by the user.

Figure 21:
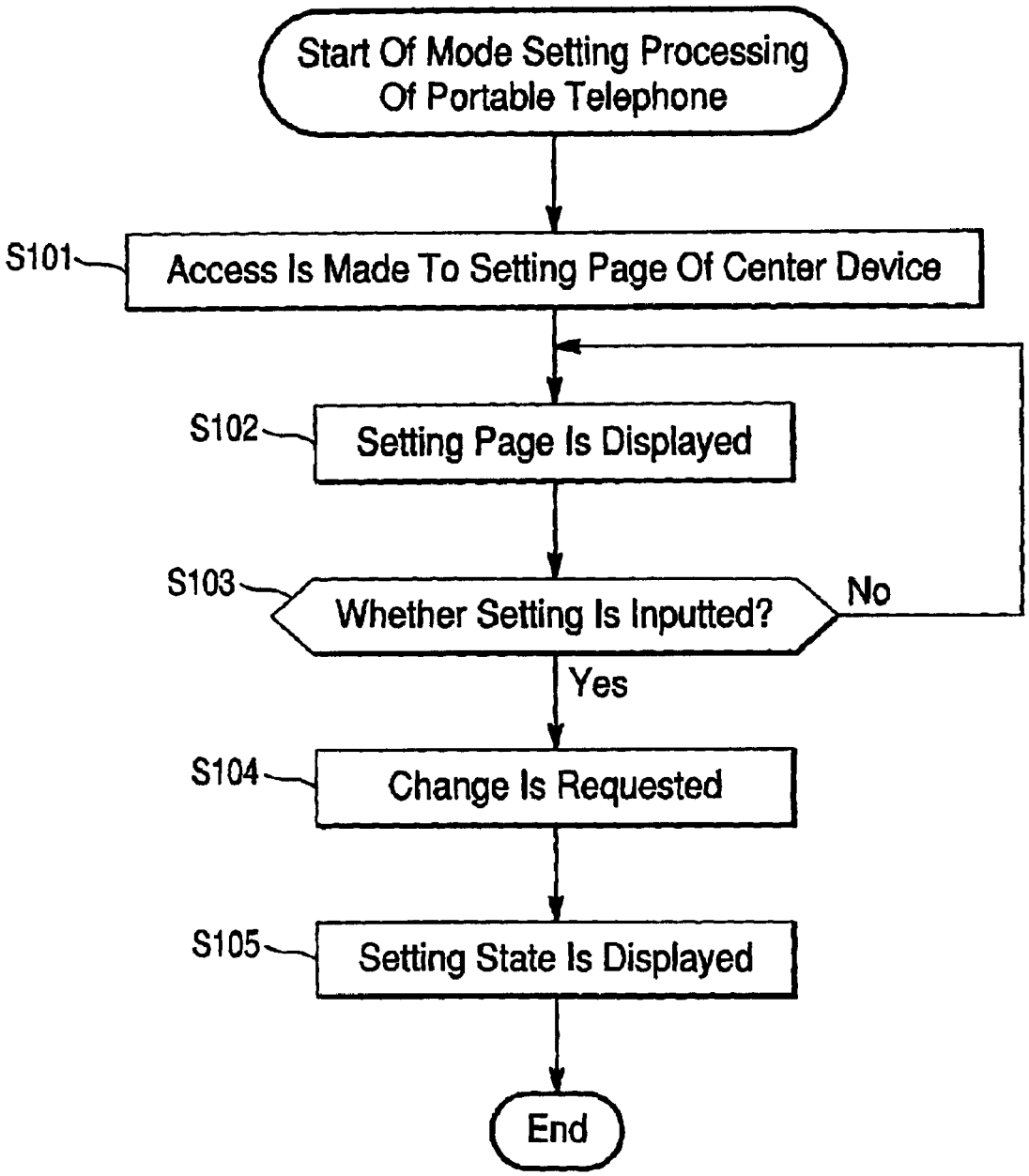
FIG. 21 is a flowchart for explaining another processing of a portable telephone according to an embodiment of the present invention.

Next, a mode setting processing of the portable telephone 71 will be described with reference to the flowchart of FIG. 21.

At step S101, in response to an input of mode setting from the input portion 126, the control portion 121 accesses a predetermined setting page prepared in the center device 82, and at step S102, a setting page acquired from the center device 82 is displayed on the LCD 125.

Figure 22:
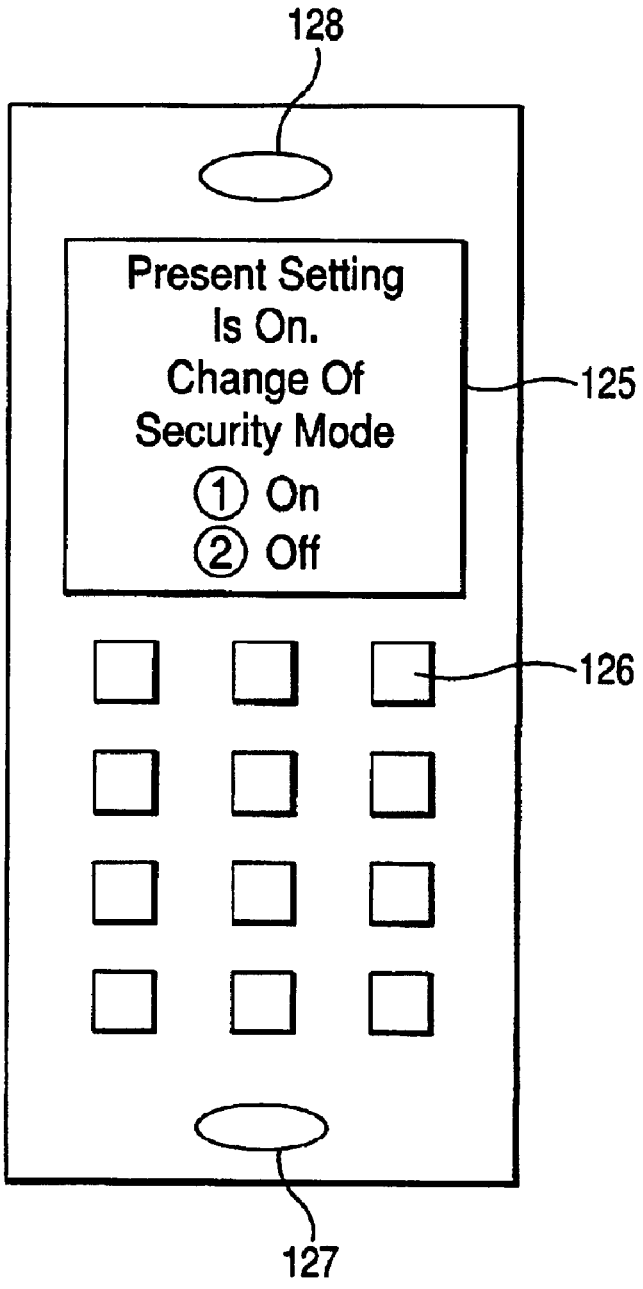
FIG. 22 is a view showing still another display example of a portable telephone according to an embodiment of the present invention.

FIG. 22 is a view showing an example of a mode setting screen displayed on the LCD 125. The user who confirms this screen can turn on the security mode by operating, for example, a button No. 1 of a ten-key keypad (e.g., the input portion 126), and can turn off the security mode by operating a button No. 2. Incidentally, the present setting mode and the like are also displayed.

At step S103, the control portion 121 judges whether or not the setting is inputted from the input portion 126, and waits until it is inputted. When the control portion 121 judges that the setting is inputted, it proceeds to step S104 and requests the center device 82 to change the setting. For example, on the screen as shown in FIG. 22, when the button of No. 2 of the ten-key keypad is operated, the control portion 121 requests that the security mode is changed from the on state to the off state.

Then, at step S105, the setting state of the present mode, which has been changed, is displayed and the user confirms it.

Figure 23:
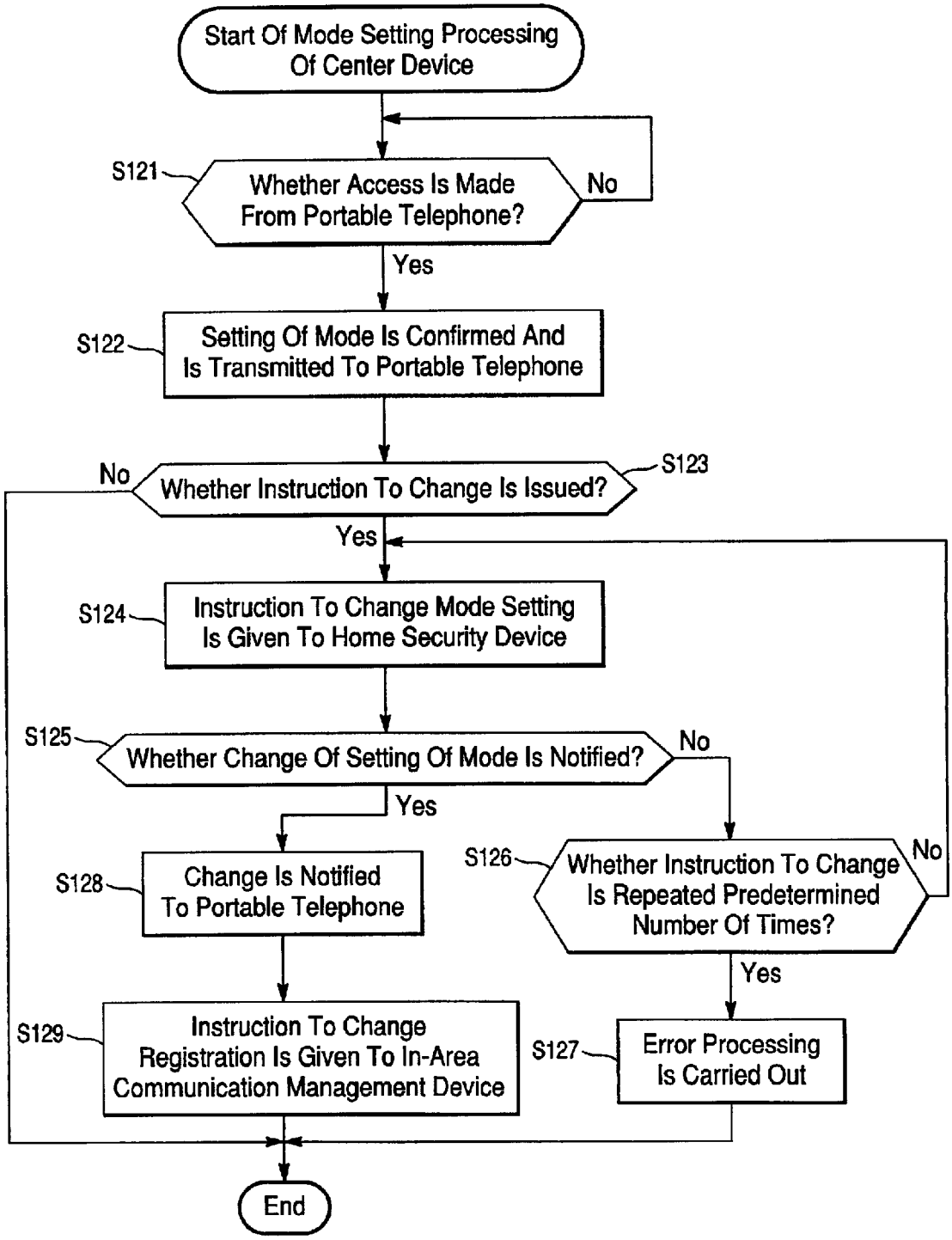
FIG. 23 is a flowchart for explaining still another processing of a center device according to an embodiment of the present invention.

Next, a mode setting processing of the center device 82 will be described with reference to the flowchart of FIG. 23.

At step S121, the center control device 101 judges whether or not it is accessed from the portable telephone 71, and waits until a judgment that it is accessed is made. Then, in the case where the judgment that it is accessed is made, the center control device 101 proceeds to step S122, confirms the present mode of the accessing home security device 81 stored in the storage device 104, and transmits it, together with a setting page of a mode, to the portable telephone 71 through the communication network 83. Then, the setting screen as shown in FIG. 22 is displayed on the portable telephone 71, and the setting is inputted by the user.

At step S123, the center control device 101 judges whether or not an instruction to change the setting of the mode is issued, and in the case where a judgment that the instruction is not issued, the processing is terminated. On the other hand, at the step S123, in the case where the center control device 101 judges that the instruction to change the mode is issued, it proceeds to step S124, and instructs the home security device 81 installed in the house of the user using the portable telephone 71 to change the setting of the mode through the communication network 83 and the in-area communication management device 32.

In response to the instruction to change, the home security device 81 changes the setting, and notifies the center device 82 that the setting is changed.

At step S125, the center control device 101 judges whether or not notice that the setting of the mode is changed is given from the home security device 81, and in the case where it judges that the notice is not given, it proceeds to step S126. Then, the center control device 101 judges whether or not the instruction to change the setting is repeatedly given to the home security device 81 a predetermined number of times, for example, three times, and it returns to the step S124 until it judges that the instruction has been repeatedly given, and the subsequent processing is repeatedly carried out.

On the other hand, at the step S126, in the case where the center control device 101 judges that notice of the change of the setting of the mode is not given from the home security device 81 though the instruction to change has been repeatedly given the predetermined number of times, it proceeds to step S127, and carries out an error processing. For example, the instruction which has been repeatedly given the plural number of times is memorized, and the notice is given to the portable telephone 71. By this, for example, in the case where the home security communication device 42 is out of order, the user of the portable telephone 71 can confirm that. Alternatively, as described above, the alarm may be given to the neighbor residents.

On the other hand, at the step S125, in the case where the center control device judges that notice of the change of the setting of the mode is given from the home security device 81, it renews information relating to the setting state of the mode stored in the storage device 104, proceeds to step S128, and notifies the portable telephone 71 that the setting of the mode has been completed normally. Then, the center control device proceeds to step S129, and notifies the in-area communication management device 32 that the setting of the objective home security device 81 is changed.

Figure 24:
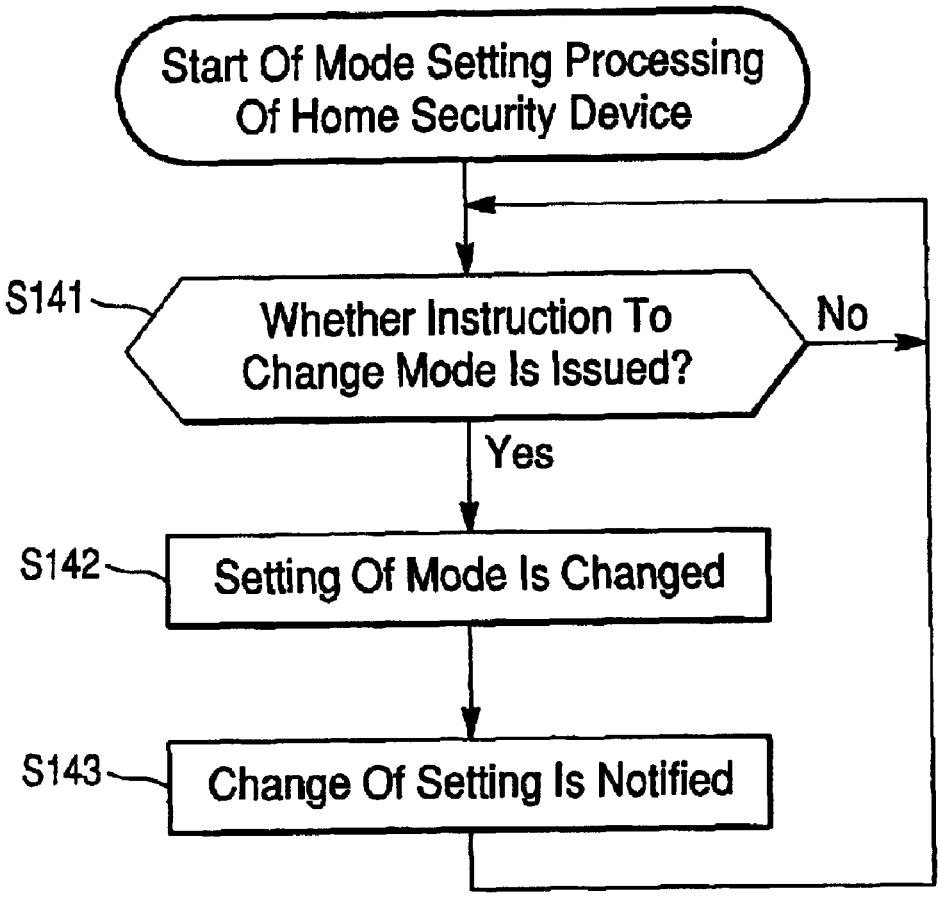
FIG. 24 is a flowchart for explaining still another processing of a home security device according to an embodiment of the present invention.

Next, a mode setting processing of the home security device 81 will be described with reference to the flowchart of FIG. 24.

At step S141, on the basis of the output from the home security communication device 42, the home security control device 51 judges whether or not the instruction to change the mode is issued from the center device 82, and waits until a judgment that the instruction to change the mode is issued. Then, in the case where the home security control device 51 judges that the instruction to change the mode is issued, it proceeds to step S142, changes the mode, controls the home security communication device 42 at step S143, and notifies the center device 82 that the setting is changed.

By the foregoing series of processings, even in the case where the user is out, he can change the security mode of the house by the portable telephone 71. Naturally, the user can change the setting by operating the operation button 96 provided in the home security device 81.

Figure 25:
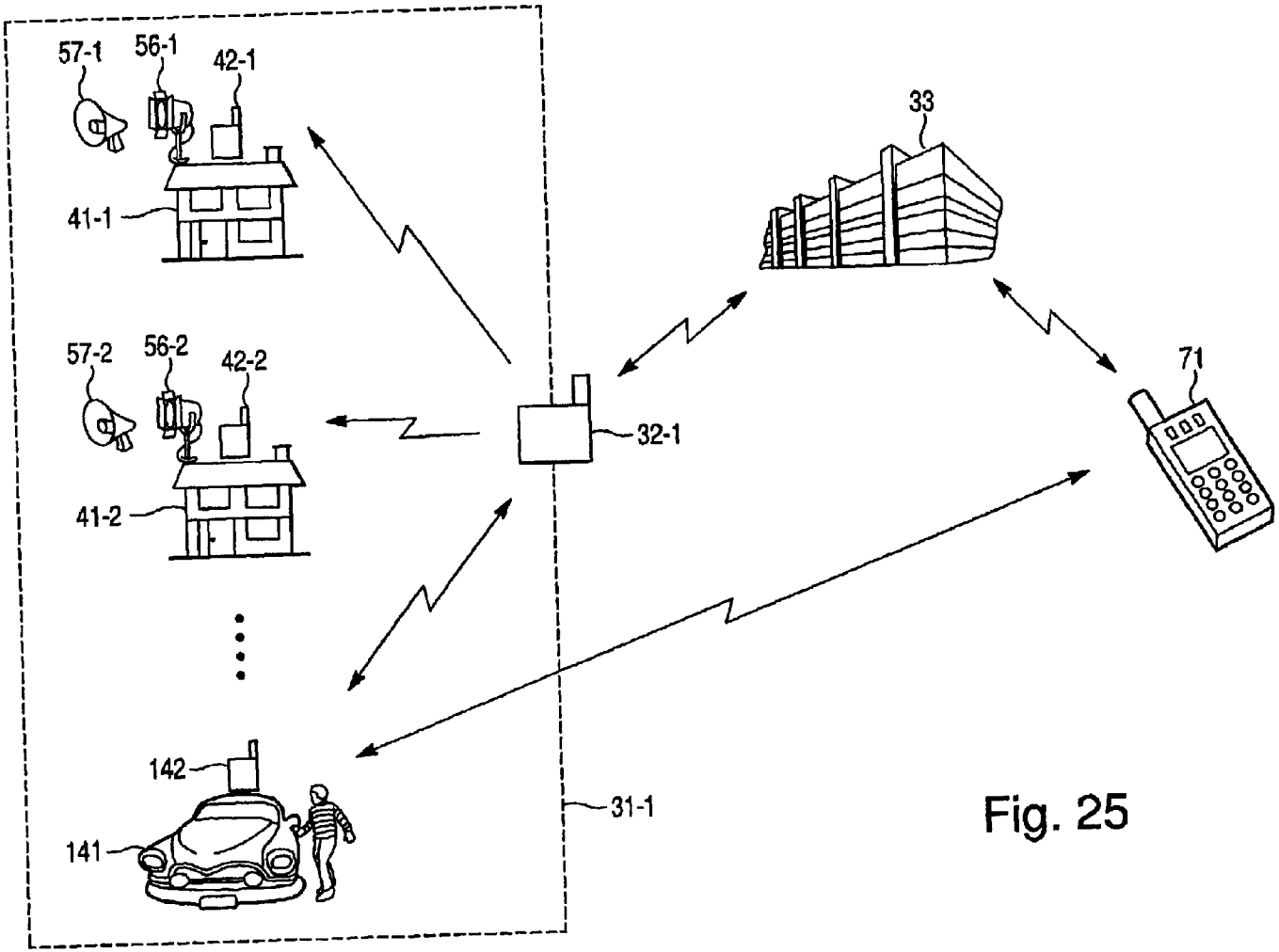
FIG. 25 is a view showing a conception of still another security system to which the present invention is applied according to an embodiment of the present invention.

FIG. 25 is a view showing a conception of another security system according to the present invention.

Although the discovery embodiments describe the case where the unusual situation occurring in the house is notified, the present invention can also be applied to the case where an unusual situation of a vehicle, for example, stealing or malicious mischief is notified.

In a vehicle 141, a device having a similar function as the foregoing home security device 81 is prepared as an on-vehicle device 151. For example, when a person who attempts to steel the vehicle appears and a sensor detects it, the sensor notifies the monitor center 33 through the in-area communication management device 32-1. Incidentally, for purposes of illustration and explanation, it is assumed that the vehicle 141 is owned by the resident of the house 41-1, and is parked in a parking zone in the vicinity of the house 41-1.

In the case where the unusual situation is detected in the vehicle 141, the monitor center 33 gives notice of it to the previously registered portable telephone 71 and the home security device 81-1 of the house 41-1 by electronic mail or voice. Then, the owner (the resident of the house 41-1) who observes the notification goes to the vehicle 141 to confirm it, so that the stealing of the vehicle 141 can be prevented from occurring.

In the case where the owner of the vehicle 141 is not present in the vicinity of the vehicle 141 and can not confirm the vehicle immediately, he makes a remote control operation using the portable telephone 71 to, for example, sound the horn of the vehicle 141, and can threaten the person through the input/output device 171. For example, in the case where the vehicle 141 is stolen and a chase mode is activated, the on-vehicle control device 162 notifies the center device 82 of the position information at interval of a predetermined time through the communication network 83.

The sensor 163 may comprise, for example, an acceleration sensor 174 for detecting the acceleration or jolting of the whole of the vehicle 141, a door sensor 175 for detecting the opening and shutting of a door, and/or a trunk sensor 176 for detecting the opening and shutting of a trunk, and when detecting unusualness, the sensor outputs it to the on-vehicle control device 162 through the input/output device 171. The outside device 164 may comprise a horn 177 and/or a lamp 178.

Figure 28:
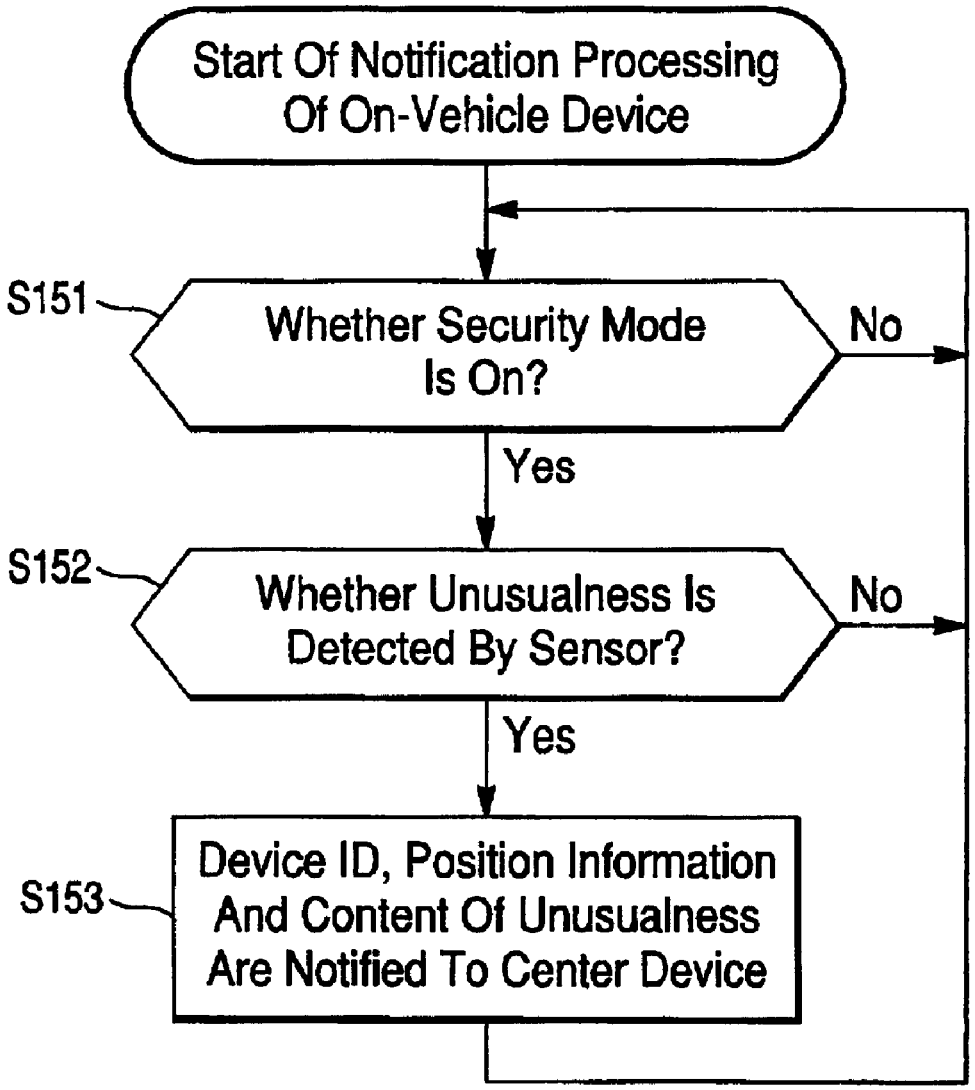
FIG. 28 is a flowchart for explaining a processing of the on-vehicle device according to an embodiment of the present invention.

Next, an operation of the security system of FIG. 25 will be described. First, a notification processing of the on-vehicle device 151 will be described with reference to the flowchart of FIG. 28.

At step S151, the on-vehicle control device 162 judges whether or not the security mode is on, and waits until a judgment that it is on is made. Then, in the case where the on-vehicle control device 162 judges that the security mode is on, it proceeds to step S152, and judges whether or not the vehicle 141 is being stolen.

As described above, the monitor center 33 notifies the other home security devices 81 in the area 31-1 through the in-area communication management device 32-1 that there is a person attempting to steal the vehicle 141, in the vicinity. By notifying other home security devices 81 in the area, the spread of damage can be suppressed, or the neighbor residents can cooperate with one another to arrest the person who attempts to steal the vehicle 141.

Figure 26:
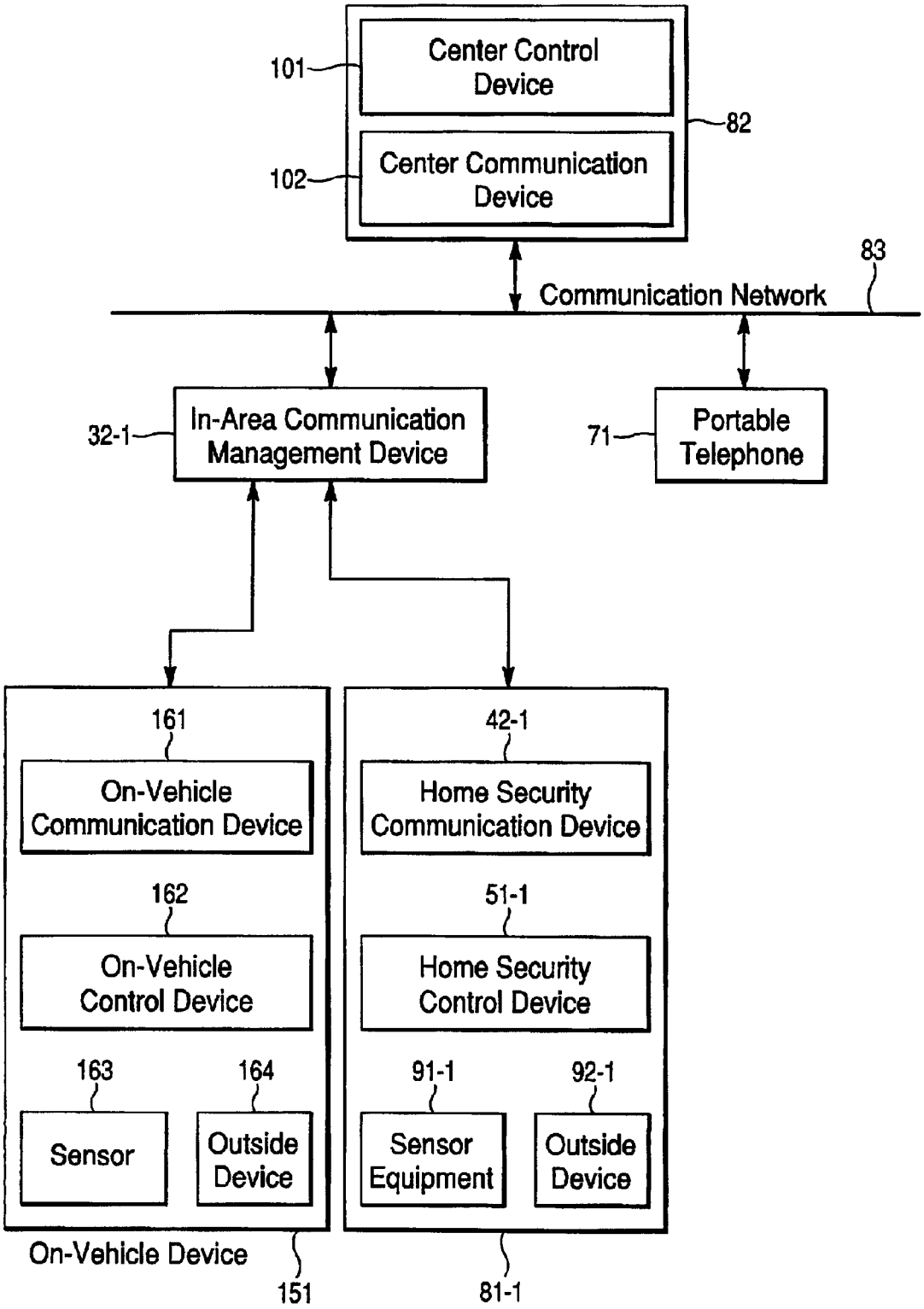
FIG. 26 is a block diagram showing a structural example of the security system of FIG. 25 according to an embodiment of the present invention.

FIG. 26 is a block diagram showing a structural example of the security system of FIG. 25. The explanation of the similar portion as that of FIG. 5 is suitably omitted. Incidentally, in FIG. 26, only the home security device 81-1 installed in the house 41-1 is shown, however, similarly to FIG. 5, they are connected to the communication network 83 through the in-area communication management device 32-1.

The on-vehicle device 151 comprises an on-vehicle communication device 161, an on-vehicle control device 162, a sensor 163 for detecting an unusual situation, and/or an outside device 164 for threatening a person who attempts to steal the vehicle, including a horn, a light and the like.

The on-vehicle control device 162 controls the whole operation of the on-vehicle device 151, and when unusualness is detected by the sensor 163, the on-vehicle control device controls the on-vehicle communication device 161, and notifies the center device 82 of that through the in-area communication management device 32-1. When an instruction to drive the outside device 164 is issued from the center device 82 to threaten the person attempting to steal the vehicle, the on-vehicle control device 162 controls the outside device 164.

Figure 27:
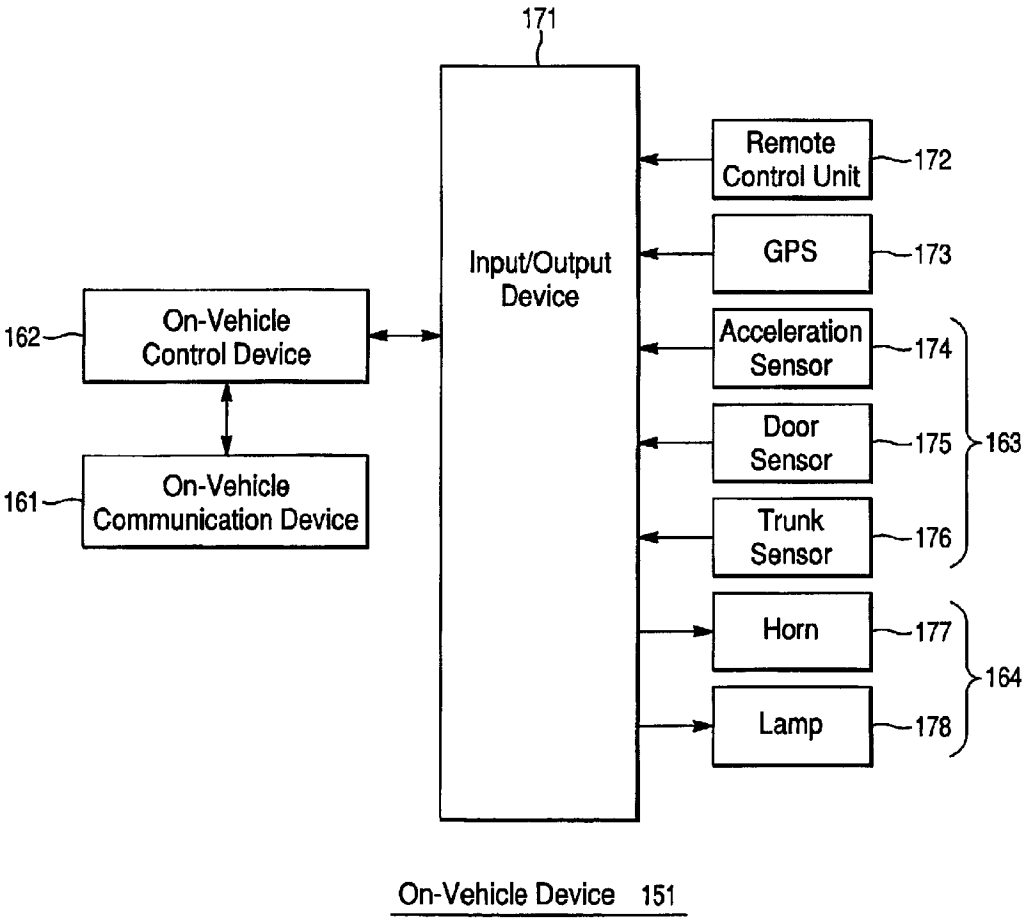
FIG. 27 is a block diagram showing a detailed structural example of an on-vehicle device of FIG. 26 according to an embodiment of the present invention.

FIG. 27 is a block diagram showing a detailed structural example of the on-vehicle device 151 according to an embodiment of the present invention.

The on-vehicle control device 162 substantially controls the whole operation of the on-vehicle device 151 through an input/output device 171. The input/output device 171 is connected with a remote control unit 172, a GPS 173, the foregoing sensor 163, and/or the outside device 164.

The remote control unit 172 comprises an operation portion and a light receiving portion for receiving a signal. The change of a security mode or the like can be inputted into the remove control unit. The GPS 173 detects the present position on the basic of the instruction from the on-vehicle control device 162, and notifies the on-vehicle control device 162 of the unusualness as detected by the sensor 163.

At the step S152, in the case where the on-vehicle control device 162 judges that unusualness is not detected, it returns to the step S151, and the subsequent processing is repeatedly carried out. On the other hand, in the case where the on-vehicle control device 162 judges that unusualness is detected, it proceeds to step S153, and transmits the device ID of the on-vehicle device 151 and the content of the unusualness (e.g., information as to which sensor detects the unusualness) to the center device 82 through the in-area communication management device 32-1. The on-vehicle control device 162 controls the GPS 173, acquires the present position information, and transmits the acquired position information to the center device 82.

Figure 29:
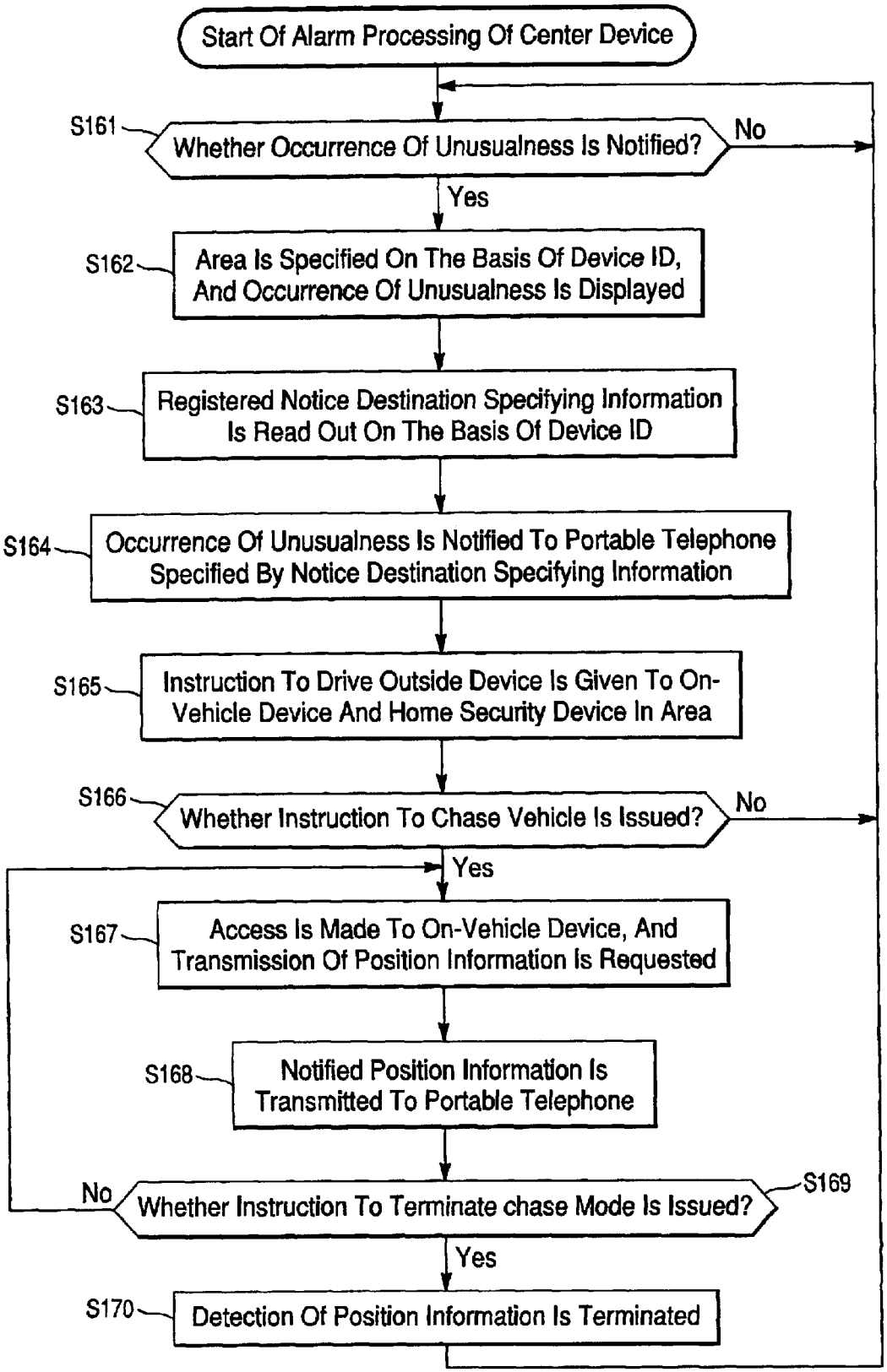
FIG. 29 is a flowchart for explaining a processing of a center device according to an embodiment of the present invention.

Next, an alarm processing of the center device 82 will be described with reference to the flowchart of FIG. 29.

At step S161, the center control device 101 judges whether or not the occurrence of the unusualness is notified from the on-vehicle device 151, and waits until a judgment that it is notified is made. When the center control device 101 judges that the occurrence of the unusualness is notified from the on-vehicle device 151, it proceeds to step S162, and on the basis of the position information notified from the on-vehicle device 151, it confirms the present position of the vehicle, and displays map information of the neighbor area on the CRT 105.

Figure 30:
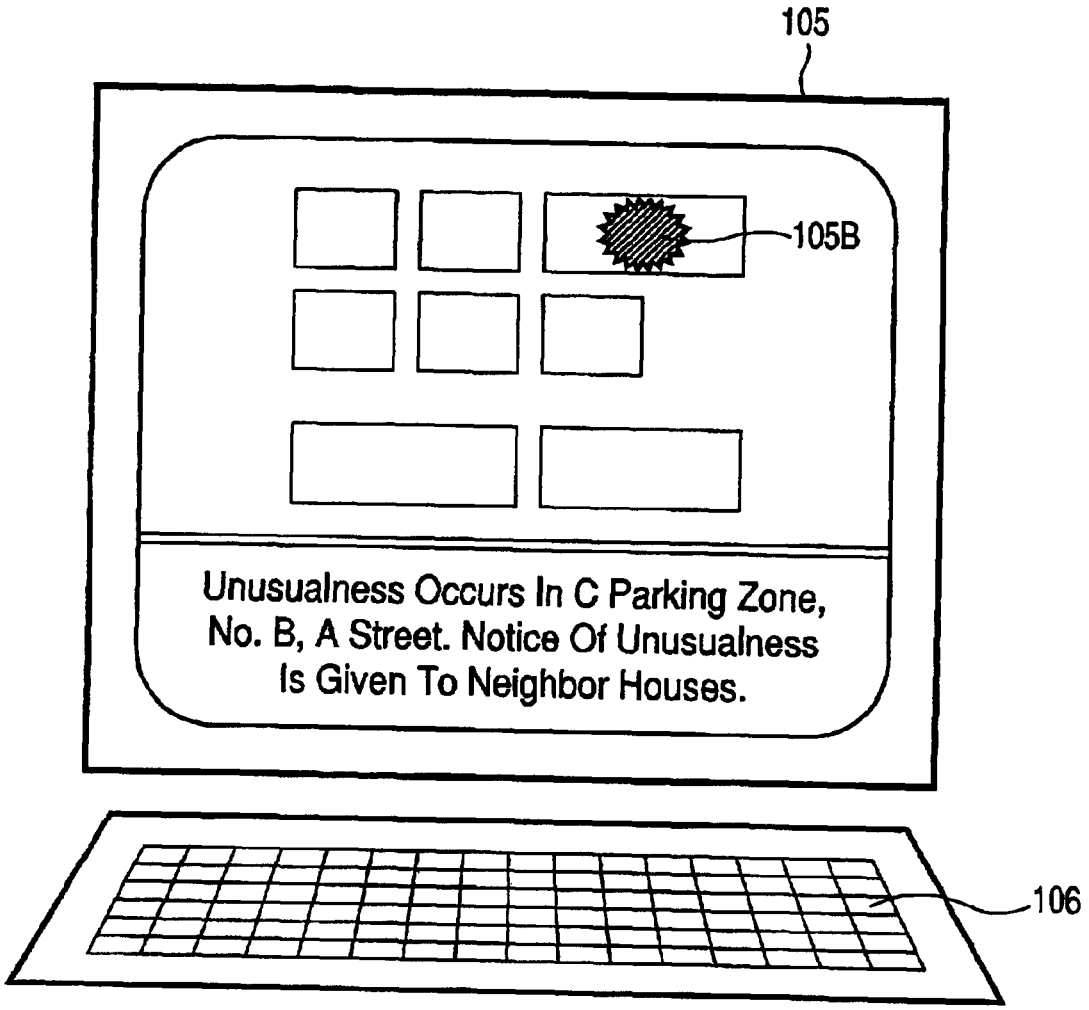
FIG. 30 is a view showing another display example of the center device according to an embodiment of the present invention.

FIG. 30 is a view showing a display example of the CRT 105, and this example shows a case where the occurrence of the unusual situation is detected in the vehicle parked in the parking zone.

As shown in the drawing, the map of the neighbor area including the place where the occurrence of the unusual situation is detected is displayed, and the position of the vehicle is specified by a pointer 105B. Then, as a message to a manager of the center device 82, "Unusualness occurs in C parking zone, No. B, A Street. Notice of the unusualness is given to neighbor houses" is displayed.

Incidentally, in the case where only the unusual situation occurring in the parking zone is monitored, even if the area is not specified on the basis of the position information detected by the GPS 173 as described above, the area in the vicinity of the previously registered parking zone can alternatively be displayed on the basis of the notified device ID alone.

At step S163, the center control device 101 reads out registered destination specifying information from the storage device 104 on the basis of the notified device ID. As described above, the user using the security system of FIG. 25 previously registers the telephone number of the personally used portable telephone or the like as the notice destination to which information is sent when an unusual situation occurs.

Then, at step S164, the center control device 101 notifies the portable telephone specified by the notice destination specifying information read out at the step S163 that there is a fear that an unusual situation occurs in the vehicle. This information is outputted from the center communication device 102, and is transmitted to the portable telephone 71 through the communication network 83.

At step S165, the center control device 101 instructs the on-vehicle device 151 to drive the outside device 164, and instructs the other home security devices 81 in the area where the parking zone exists to display the occurrence of the unusual situation in the vicinity on the respective LCDs 94 and to drive the outside devices 92.

For example, as shown in FIG. 30, in the case where the occurrence of the unusual situation is detected in the on-vehicle device 151 of the vehicle parked in the parking zone in the vicinity of the house 41-1, the instruction to display a message giving caution is issued to the home security devices 81-1 to 81-N, the outside lights 56 and the outside speakers 57 prepared for the respective home security devices 81 are driven, and warning is given against a person who attempts to steal the vehicle 141. In the case where the vehicle 141 has been stolen and moved to a place other than the normal parking zone, the warning may be given to the surrounding area of the present position of the vehicle 141.

Figure 31:
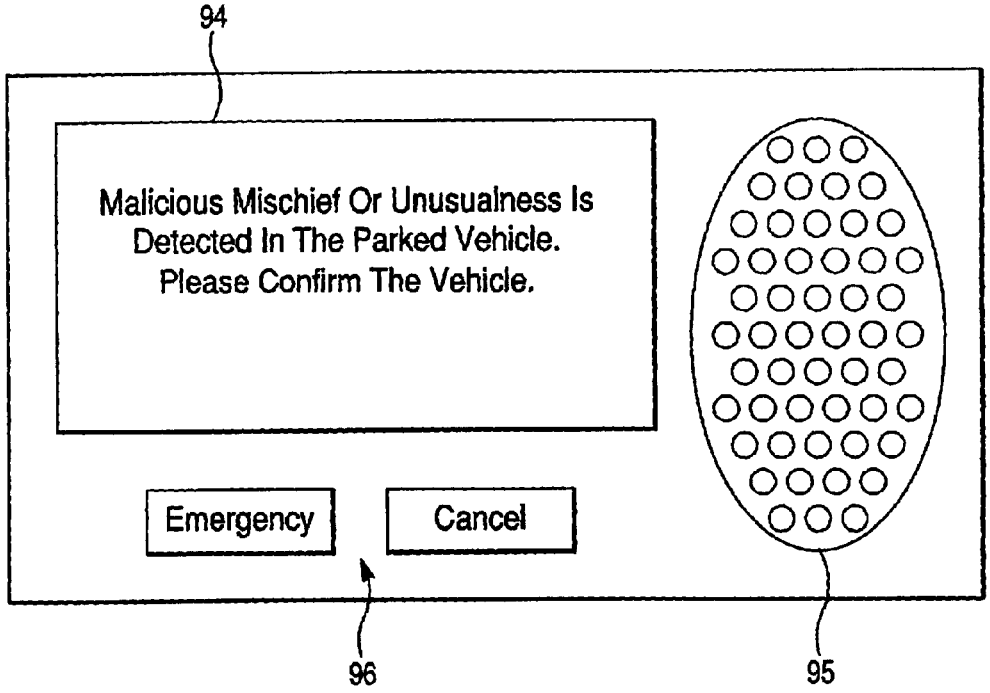
FIG. 31 is a view showing another display example of a home security device according to an embodiment of the present invention.

FIG. 31 is a view showing an example of a message displayed on the home security device 81 installed in the house of the owner of the vehicle 141 in which the unusual situation is detected. As shown in the drawing, a message "Malicious mischief or unusualness is detected in the parked vehicle. Please confirm the vehicle." is displayed on the LCD 94.

On the basis of the message displayed on the portable telephone 71 by the processing of the step S164, or on the basis of the message displayed on the home security device 81 of the house by the processing of the step S165, the user confirms the occurrence of the unusualness of his own vehicle 141.

At step S166, the center control device 101 judges whether or not an instruction to chase the vehicle is issued. That is, in the case where the vehicle 141 has already been stolen when the owner of the vehicle 141 confirms it, the owner accesses the center device 82 from the portable telephone 71 and can give the instruction to chase the position of the vehicle 141.

At step S166, in the case where the center control device 101 judges that the instruction to chase is not issued, it returns to the step S161, and the subsequent processing is repeatedly carried out. On the other hand, at the step S166, in the case where the center control device 101 judges that the instruction to chase the vehicle is issued, it carries out the chase mode, proceeds to step S167, accesses the on-vehicle device 151, and requests the transmission of position information. The chase processing is carried out until an instruction to terminate the chase mode is issued from the portable telephone 71, and an inquiry about the present position of the vehicle 141 is made by the center device 82 at intervals of a predetermined time.

The center control device 101 notifies the portable telephone 71 of the position information of the vehicle 141 through the communication network 93. By this, the user of the portable telephone 71 can confirm the present position of the vehicle 141 changing momentarily.

At step S169, on the basis of the output from the center communication device 102, the center control device 101 judges whether or not the instruction to terminate the chase mode is issued from the portable telephone 71, and returns to the step S167 until a judgment that the instruction to terminate it has been issued is made, and the subsequent processing is repeatedly carried out. On the other hand, at the step S169, in the case where the center control device 101 judges that the instruction to terminate the chase mode has issued from the portable telephone 71, it proceeds to step S170, and instructs the on-vehicle device 151 to terminate the detection of the position information. Then, it returns to the step S161, and the subsequent processing is repeatedly carried out.

Figure 32:
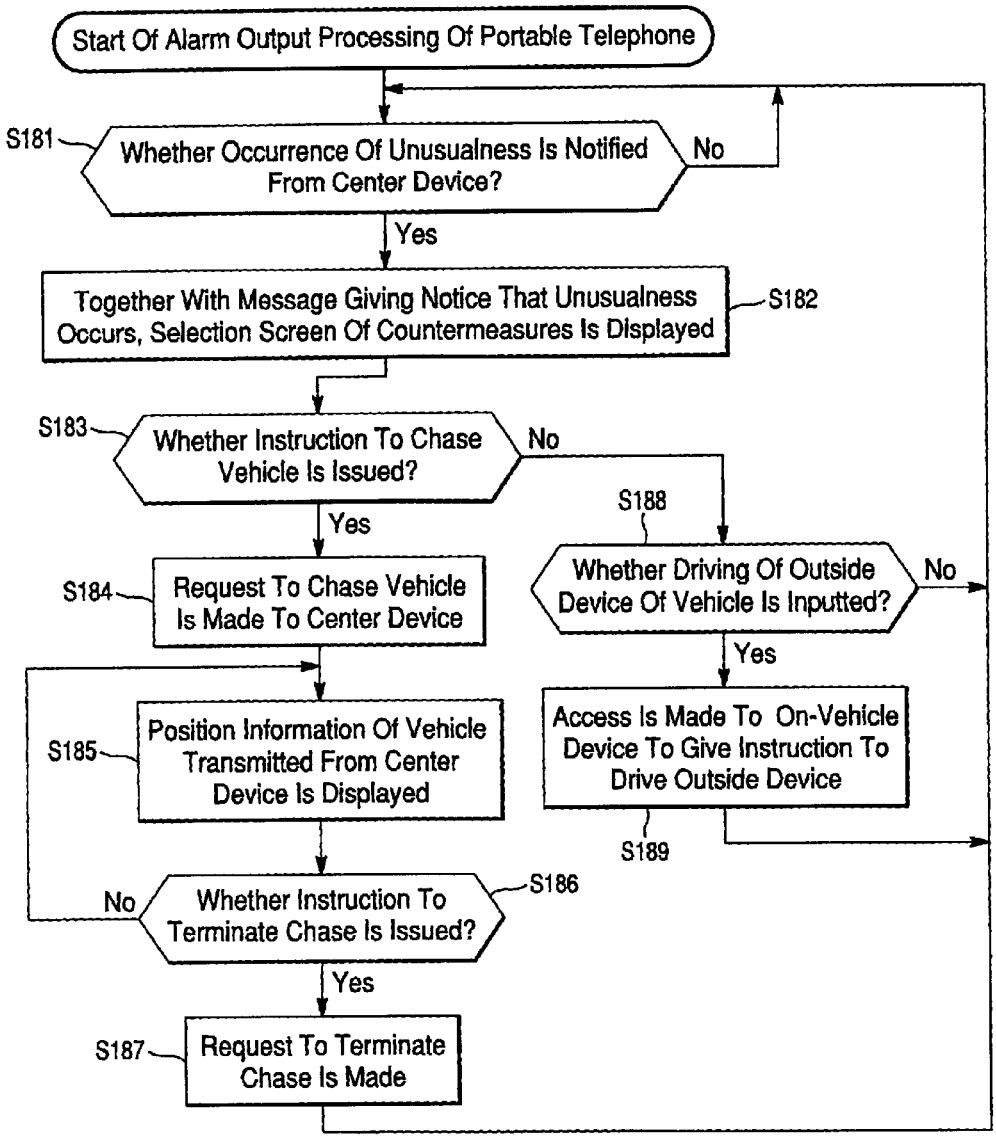
FIG. 32 is a flowchart for explaining still another processing of a portable telephone according to an embodiment of the present invention.

Next, an alarm output processing of the portable telephone 71 will be described with reference to the flowchart of FIG. 32.

At step S181, the control device 121 judges whether or not the detection of the occurrence of the unusual situation in the vehicle 141 is notified from the center device 82, and waits until a judgment that it is notified is made. In the case where the control portion 121 judges that the occurrence of the unusual situation is notified, it proceeds to step S182, and displays a selection screen of countermeasures, together with a message giving notice that the unusualness occurs, on the LCD 125.

As described above, in the case where the vehicle 141 has already been stolen when the owner of the vehicle 141 goes to the vehicle and confirms it, the owner can instruct the center device 82 to chase the position of the vehicle 141. Accordingly, for example, the screen for selecting the execution of the chase mode is displayed on the LCD 125.

Figure 33:
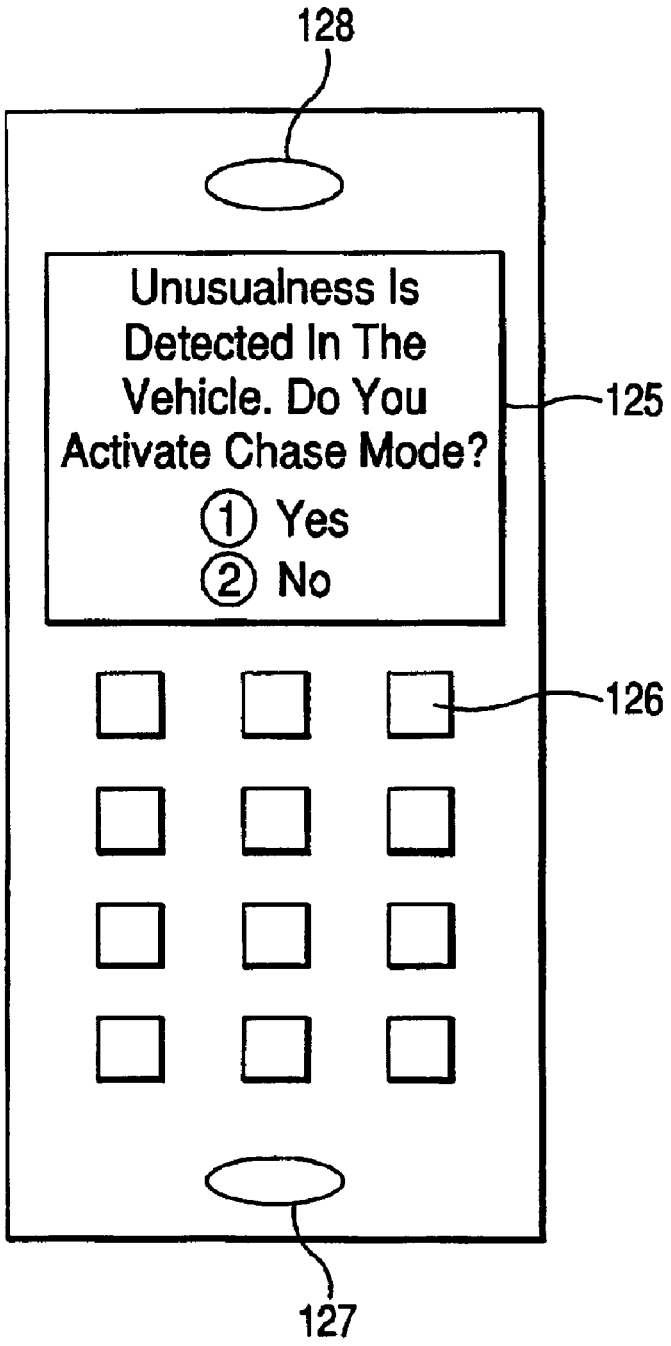
FIG. 33 is a view showing a display example of the portable telephone according to an embodiment of the present invention.

FIG. 33 is a view showing an example of a message giving notice that unusualness is detected to the owner of the vehicle 141 and an example of the selection screen for selecting the countermeasures. As shown in the drawing, for example, a message "Unusualness is detected in the vehicle. Do you activate the chase mode?" is displayed, and the owner operates the input portion 126 in response to this screen, and can select whether or not the chase mode is to be executed.

At step S183, on the selection screen as shown in FIG. 33, the control portion 121 judges whether or not the chase mode is selected, and in the case where a judgment that it is selected is made, the control portion proceeds to step S184, controls the communication portion 122, and requests the center device 82 to chase the vehicle 141.

Since the position information of the vehicle 141 is transmitted from the center device 82 at intervals of a predetermined time in response to this request, the control portion 121 displays it on the LCD 125 at step S185.

At step S186, on the basis of the input from the input portion 126, the control portion 121 judges whether or not the termination of the chase of the vehicle 141 is inputted from the user, and until a judgment that it is inputted is made, the control portion returns to the step S185, and the subsequent processing is repeatedly carried out.

For example, in the case where the safety of the vehicle is confirmed and the user inputs the termination of the chase of the vehicle 141, at step S187, the control portion 121 requests the center device 82 to terminate the chase of the vehicle. Thereafter, the processing is returned to the step S181, and the subsequent processing is repeatedly carried out.

On the other hand, at the step S183, in the case where the control portion 121 judges that the chase of the vehicle 141 is not selected, it proceeds to step S188. As described above, the owner of the vehicle 141 can drive the horn 177 and/or the lamp 178 by remote control using the portable telephone 71. Incidentally, the owner of the vehicle 141 may be enabled to operate the outside device 164 by remote control by accessing a predetermined page of the center device 82 through the portable telephone 71.

At the step S188, the control portion 121 judges whether or not an instruction to drive the outside device 164 is inputted, and in the case where a judgment that it is inputted is made, the control portion proceeds to step S189, accesses the on-vehicle device 151, and operates the outside device 164 by remote control. By this, for example, the horn 177 is driven, and it is possible to threaten the person who attempts to steal the vehicle 141.

Figure 34:
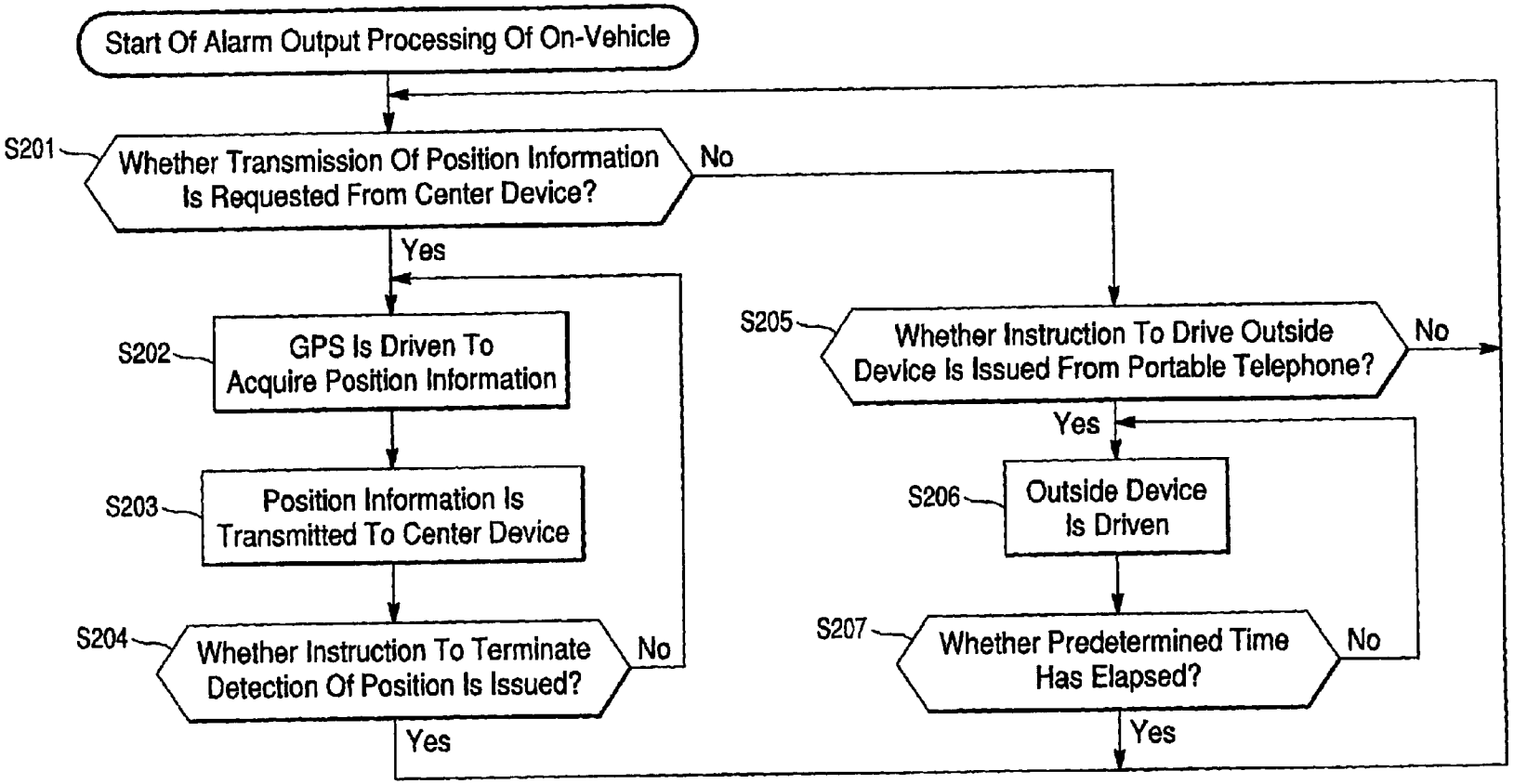
FIG. 34 is a flowchart for explaining another processing of an on-vehicle device according to an embodiment of the present invention.

Next, a remote control processing of the on-vehicle device 151 carried out in response to an instruction from the center device 82 will be described with reference to the flowchart of FIG. 34.

At step S201, the on-vehicle control device 162 judges whether or not the transmission of the position information is requested from the center device 82. When the vehicle 141 is parked in the parking zone, the center device 82 communicates with the on-vehicle device 151 through the in-area communication management device 32. However, for example, in the case where the vehicle 141 is stolen, the center device changes the communication party to a base station which can access the on-vehicle device 151, and carries out the remote control processing.

At the step S201, in the case where the on-vehicle control device 162 judges that the transmission of the position information is requested from the center device 82, it proceeds to step S202, drives the GPS 173, and acquires the position information. Then, at step S203, the on-vehicle control device 162 transmits the position information acquired at the step S202 to the center device 82 from the on-vehicle communication device 161.

At step S204, the on-vehicle control device 162 judges whether or not the instruction to terminate the detection of the position information is issued from the center device 82, returns to the step S202, repeatedly detects the present position at intervals of a predetermined time, and notifies the center device 82 of that. In the case where the on-vehicle control device judges that the instruction to terminate the detection of the position information is issued, it returns to the step S201 and the subsequent processing is repeatedly carried out.

On the other hand, at the step S201, in the case where the on-vehicle control device 162 judges that the transmission of the position information is not requested from the center device 82 (in the case where it judges that the chase mode is not selected), it proceeds to step S205, and judges whether or not an instruction to drive the outside device 164 is issued from the portable telephone 71. In the case where the on-vehicle control device judges that the instruction is issued, it proceeds to step S206, and drives the indicated outside device 164. For example, in the case where the instruction to drive the horn 177 is issued, the on-vehicle control device 162 drives the horn 177 and continues to sound the horn 177 until a judgment that a predetermined time has elapsed is made at step S207. At the step S207, in the case where the on-vehicle control device 162 judges that the predetermined time has elapsed since the outside device 164 was driven, it returns to the step S201 and the subsequent processing is repeatedly carried out.

In the above, although the occurrence of the unusualness is notified from the on-vehicle device 151, the center device 82 may access the on-vehicle device 151 to confirm the state of the vehicle 141.

Figure 35:
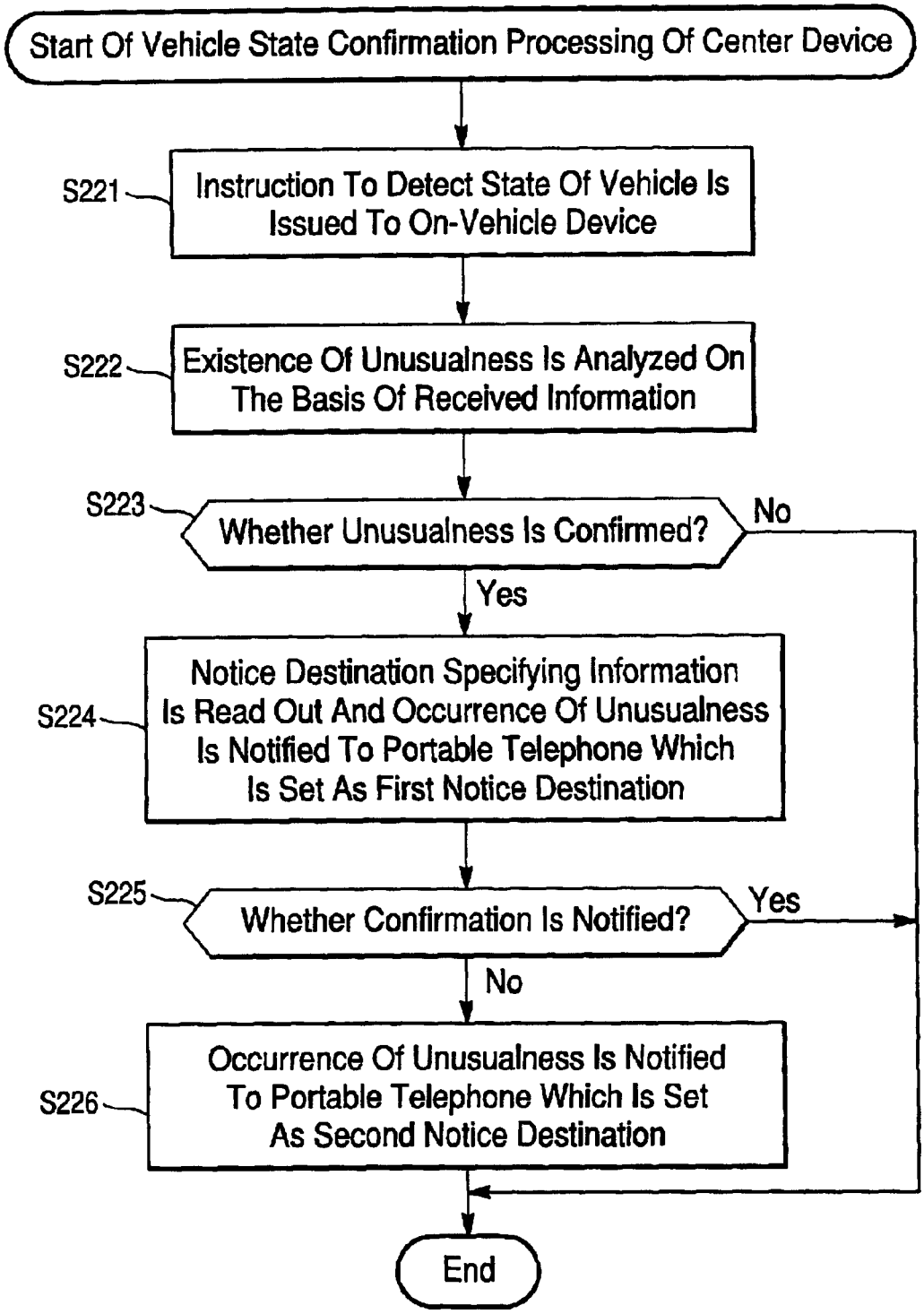
FIG. 35 is a flowchart for explaining another processing of the center device according to an embodiment of the present invention.

A processing in which the center device 82 accesses the on-vehicle device 151 to confirm the state of the vehicle 141, will now be described with reference to the flowchart of FIG. 35.

At step S221, the center control device 101 communicates with the on-vehicle device 151, and issues an instruction to detect the state of the vehicle 141. For example, since the present states of the respective sensors 163, or the histories of the detection signals of the sensors 163 stored in a not-shown memory, are notified in response to this instruction, the center control device 101 analyzes the existence of unusualness on the bases of this at step S222.

At step S223, the center control device 101 judges whether or not the unusualness is confirmed, and in the case where a judgment that it is not confirmed is made, the processing is ended. On the other hand, for example, on the basis of the past history, in the case where acceleration (swing) exceeding a predetermined threshold value has been detected by the acceleration sensor 174, the center control device 101 recognizes that unusualness occurs, and proceeds to step S224.

At the step S224, the center control device 101 reads out the notice destination specifying information stored in the storage device 104 correspondingly to the device ID of the on-vehicle device 151, and notifies the portable telephone, which is set as the first destination, of the occurrence of the unusualness by, for example, transmitting a predetermined message as described above.

At step S225, the center control device 101 judges whether or not confirmation of the message is notified from the portable telephone to which notice of the occurrence of the unusual situation is given. When the center control device 101 judges that the notice of the confirmation of the message by the user of the portable telephone, which is set as the first destination, is given, it terminates the processing.

On the other hand, at the step S225, in the case where the center control device 10 judges that the notice of the confirmation of the message by the user of the portable telephone, which is set as the first destination, is not given, it proceeds to step S226, and notifies a portable telephone, which is set as a second destination, that the unusualness occurs in the vehicle 141.

In the case where the portable telephone is notified by electronic mail or the like, there is often a case where the user does not notice. Thus, by setting a plurality of notice destinations in this way, the occurrence of the unusual situation can be notified more certainly, and countermeasures can be taken.

Incidentally, in a system which gives notice of the unusualness occurring in the house, a plurality of notice destinations can be similarly set in this way.

Figure 36:
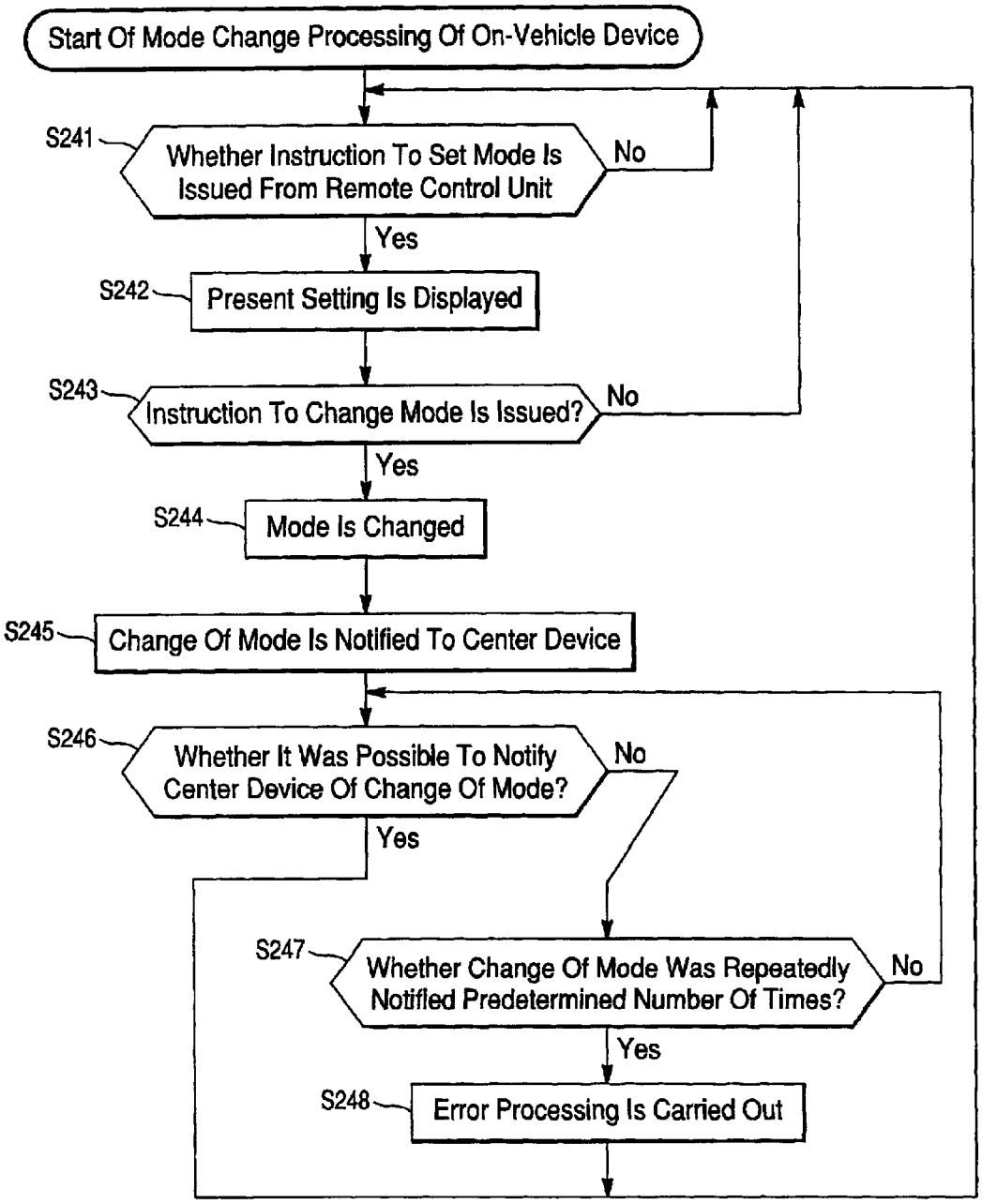
FIG. 36 is a flowchart for explaining still another processing of the on-vehicle device according to an embodiment of the present invention.

Next, a processing of the on-vehicle device 151 for changing the security mode by using the remote control unit 172 will be described with reference to the flowchart of FIG. 36. Although the user can change the security mode of the on-vehicle device 151 from the portable telephone 71 by the same processing as that explained with reference to the flowchart of FIG. 21, in the on-vehicle device 151, the user can also change the mode by using the remote control unit 172.

At step S241, the on-vehicle control device 162 judges whether or not an instruction to set a mode is issued from the remote control unit 172, and waits until it judges that the instruction is issued. Then, in the case where it judges that the instruction is issued, it proceeds to step S242, and displays the setting of the present mode. For example, the present mode may be displayed on a not-shown display portion, or the present mode can be exhibited to the user by the number of times of lighting of the lamp 178.

At step S243, on the basis of the output from the remote control unit 172, the on-vehicle control device 162 judges whether or not the instruction to change the mode is issued, and in the case where it judges that the instruction is not issued, it returns to the step S241, and the subsequent processing is repeatedly carried out.

On the other hand, at the step S243, in the case where the on-vehicle control device 162 judges that the instruction to change the mode is issued, it proceeds to step S244, changes the mode, and causes the user to confirm the change. For example, in the case where the security mode is changed from the off state to the on state, the on-vehicle control device 162 exhibits the change of the mode to the owner by, for example, switching on the lamp 178 three times.

Then, the on-vehicle control device 162 proceeds to step S245, notifies the center device 82 that the mode is changed, and judges at step S246 whether or not the change of the mode can be notified to the center device 82. In the case where the on-vehicle control device 162 judges that the on-vehicle communication device 161 is operating normally and the change of the mode can be notified to the center device 82, it returns to the step S241, and the subsequent processing is repeatedly carried out.

On the other hand, at the step S246, in the case where the on-vehicle control device 162 judges that the change of the setting of the mode can not be notified to the center device 82, it proceeds to step S247, and judges whether or not the change of the setting of the mode is repeatedly notified to the center device 82 a predetermined number of times. In the case where the on-vehicle control device 162 judges that the notice was repeatedly given to the center device 82 the predetermined number of times, and in spite of the repeated notice, the change of the mode was not capable of being notified to the center device 82, it carries out an error processing at step S248. For example, the fact that the notice was not capable of being given is stored in the memory, and thereafter, as the needs arises, it is notified to the center device 82.

According to the present invention, since an alarm giving caution is given also to neighbor houses of a house where an unusual situation occurs, the spread of damage can be suppressed.

The foregoing description of preferred embodiments of the invention have been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined the claims appended hereto, and their equivalents.

What is claimed is:

1. An area security system for home security and vehicle security in an area, the area security system comprising:

a center device that monitors a vehicle and at least one home in a predetermined area;

an on-vehicle device that has a sensor to detect unusualness of the vehicle, a location device to detect the location of the vehicle and an on-vehicle communication device to communicate said detected unusualness and vehicle location to the center device;

at least one home security device that has a sensor to detect unusualness of a respective of the at least one home and a home communication device to communicate with the center device;

wherein, if the center device detects unusualness and location of the vehicle that is in said area by the communication from the on-vehicle device, the center device instructs the at least one home security device in the area to generate notification at the at least one home security device of the occurrence of the unusual situation.

2. An area security system according to claim 1, further comprising:

a threatening element for threatening against the occurrence of the unusual situation, wherein the threatening element is operated on the basis of control by the center device.

3. An area security system according to claim 1, wherein the on-vehicle communication device notifies the center device of the occurrence of the unusual situation by a wireless connection.

4. An area security management method for detecting an occurrence of an unusual situation in a vehicle and notifying a center device, the area security management method comprising the steps of:

detecting the occurrence of the unusual situation in the vehicle and a position of the vehicle;

notifying the center device, which is located outside the vehicle, of the occurrence of the unusual situation; and instructing, via the center device, at least one home security device in an area where the position of the vehicle is located to notify the at least one home security device of the occurrence of the unusual situation.

* * * * *